US008111230B2

(12) United States Patent
Nakai et al.

(10) Patent No.: US 8,111,230 B2
(45) Date of Patent: Feb. 7, 2012

(54) DRIVE CIRCUIT OF DISPLAY APPARATUS

(75) Inventors: Daisaburou Nakai, Kanagawa (JP); Yoshiharu Hashimoto, Kanagawa (JP)

(73) Assignee: Renesas Electronics Corporations, Kanagawa (JP)

( * ) Notice: Subject to any disclaimer, the term of this patent is extended or adjusted under 35 U.S.C. 154(b) by 1162 days.

(21) Appl. No.: 11/866,240

(22) Filed: Oct. 2, 2007

(65) Prior Publication Data

US 2008/0024420 A1 Jan. 31, 2008

Related U.S. Application Data

(63) Continuation of application No. 10/792,817, filed on Mar. 5, 2004, now Pat. No. 7,317,442.

(30) Foreign Application Priority Data

Mar. 10, 2003 (JP) ..... 2003-062766

(51) Int. Cl.
*G09G 3/36* (2006.01)

(52) U.S. Cl. ..... 345/98; 345/87

(58) Field of Classification Search ..... 345/87–102, 345/204

See application file for complete search history.

(56) References Cited

U.S. PATENT DOCUMENTS

| | | | | |
|---|---|---|---|---|
| 6,011,534 | A * | 1/2000 | Tanaka et al. | 345/98 |
| 6,014,122 | A | 1/2000 | Hashimoto | |
| 6,429,839 | B1 * | 8/2002 | Sakamoto | 345/87 |
| 6,864,866 | B2 * | 3/2005 | Aoki | 345/58 |
| 7,006,114 | B2 | 2/2006 | Sakaguchi | |
| 7,038,651 | B2 * | 5/2006 | Nitta et al. | 345/98 |
| 7,075,505 | B2 * | 7/2006 | Sakaguchi et al. | 345/87 |
| 7,106,295 | B2 * | 9/2006 | Watanabe et al. | 345/103 |
| 7,315,295 | B2 * | 1/2008 | Kimura | 345/92 |
| 7,432,901 | B2 * | 10/2008 | Baek et al. | 345/96 |
| 7,468,720 | B2 * | 12/2008 | Kim | 345/100 |
| 7,505,017 | B1 * | 3/2009 | Yeo et al. | 345/88 |
| 7,663,613 | B2 * | 2/2010 | Tanaka et al. | 345/204 |
| 2002/0039091 | A1 * | 4/2002 | Saishu et al. | 345/97 |
| 2005/0057470 | A1 | 3/2005 | Tobita | |
| 2005/0083288 | A1 * | 4/2005 | Saishu et al. | 345/97 |
| 2006/0176261 | A1 * | 8/2006 | Nitta et al. | 345/94 |
| 2007/0063953 | A1 * | 3/2007 | Iisaka | 345/96 |

FOREIGN PATENT DOCUMENTS

JP 4-73797 A 3/1992

(Continued)

*Primary Examiner* — Nitin Patel

(74) *Attorney, Agent, or Firm* — Sughrue Mion, PLLC

(57) ABSTRACT

In a drive circuit of a display apparatus in which a plurality of scanning lines and a plurality of data lines are orthogonalized, a first data latch circuit latches image data for every line in response to a horizontal signal. A decoder circuit decodes the latched image data. A gradation voltage selecting circuit selects voltage lines based on the decoded image data, to connect each of the plurality of data lines with any of the voltages lines. A data determining circuit generates determination signals based on the selected voltage lines such that each of a plurality of gradation amplifiers is selectively set to an inactive state based on the determination signal. A gradation amplifier circuit includes the plurality of gradation amplifiers, each of which amplifies a corresponding one of gradation voltages when being in an active state and does not amplify the corresponding gradation voltage when being in an inactive state, and the amplified gradation voltage being outputted on a corresponding one of the voltage lines. An output circuit drives the plurality of data lines based on the amplified gradation voltages on the voltage lines.

2 Claims, 26 Drawing Sheets

FOREIGN PATENT DOCUMENTS

| | | | |
|---|---|---|---|
| JP | 6-083295 | A | 3/1994 |
| JP | 7-75014 | A | 3/1995 |
| JP | 10-260664 | A | 9/1998 |
| JP | 10-301541 | A | 11/1998 |
| JP | 10-326084 | A | 12/1998 |
| JP | 2001-184035 | A | 7/2001 |
| JP | 2001-272655 | A | 10/2001 |
| JP | 2001-343944 | A | 12/2001 |
| JP | 2002-108301 | A | 4/2002 |
| JP | 2002-215102 | A | 7/2002 |
| JP | 2002-215108 | A | 7/2002 |
| JP | 2002-366106 | A | 12/2002 |
| JP | 2003-029725 | A | 1/2003 |
| JP | 2003-084722 | A | 3/2003 |
| JP | 2003-302949 | A | 10/2003 |
| JP | 2003-330433 | A | 11/2003 |

* cited by examiner

| | POSITIVE POLARITY (POL=H) | | NEGATIVE POLARITY (POL=L) | |
|---|---|---|---|---|
| INPUT DATA | INTERNAL DATA | Sn OUTPUT | INTERNAL DATA | Sn OUTPUT |
| 000000 | 000000 | V64 | 111111 | V1 |
| 000001 | 000001 | V63 | 111110 | V2 |
| 000010 | 000010 | V62 | 111101 | V3 |
| ⋮ | ⋮ | ⋮ | ⋮ | ⋮ |
| ⋮ | ⋮ | ⋮ | ⋮ | ⋮ |
| 111101 | 111101 | V3 | 000010 | V62 |
| 111110 | 111110 | V2 | 000001 | V63 |
| 111111 | 111111 | V1 | 000000 | V64 |

| GRADATION AMPLIFIER | POSITIVE POLARITY | NEGATIVE POLARITY |
|---|---|---|
| Vn | VRx (V) | VRx (V) |
| 1 | 0.000 | 0.000 |
| 2 | 0.330 | 0.050 |
| 3 | 0.430 | 0.150 |
| 4 | 0.540 | 0.200 |
| ⋮ | ⋮ | ⋮ |
| ⋮ | ⋮ | ⋮ |
| 29 | 2.000 | 2.250 |
| 30 | 2.100 | 2.340 |
| 31 | 2.190 | 2.430 |
| 32 | 2.320 | 2.520 |
| 33 | 2.410 | 2.610 |
| ⋮ | ⋮ | ⋮ |
| ⋮ | ⋮ | ⋮ |
| 61 | 4.330 | 4.350 |
| 62 | 4.520 | 4.490 |
| 63 | 4.710 | 4.700 |
| 64 | 5.000 | 5.000 |

| D17 | D16 | D15 | D14 | D13 | D12 | D11 | D10 | D9 | D8 | D7 | D6 | D5 | D4 | D3 | D2 | D1 | D0 |
|---|---|---|---|---|---|---|---|---|---|---|---|---|---|---|---|---|---|
| B5 | B4 | B3 | B2 | B1 | B0 | G5 | G4 | G3 | G2 | G1 | G0 | R5 | R4 | R3 | R2 | R1 | R0 |
| MSB | | | | | LSB | MSB | | | | | LSB | MSB | | | | | LSB |

| | IMAGE DATA INPUT TYPE |
|---|---|
| MODE1 | CPU_I/F |
| MODE2 | RGB_I/F+SERIAL I/F |
| MODE3 | CPU_I/F+RGB_I/F |
| MODE4 | SERIAL I/F |

DRIVE CIRCUIT OF DISPLAY APPARATUS

BACKGROUND OF THE INVENTION

1. Field of the Invention

The present invention relates to a drive circuit of a display apparatus which has a frame memory.

2. Description of the Related Art

FIG. 1 shows an example of a data line drive circuit of a display apparatus such as a liquid crystal display of a portable phone, in which a plurality of scanning lines and a plurality of data lines are arranged like a lattice. A shift register circuit 901 generates a sampling signal in synchronism with a signal DCLK when a horizontal start signal STH is supplied. Image data D0-17 are latched in a data latch circuit A 902 in synchronism with the sampling signal in order and the latched image data are latched in a data latch circuit B 903 at a time in response to the horizontal signal STB. The image data latched in the data latch circuit B 903 are decoded by a decoder circuit 904. A gradation voltage selection circuit 905 is connected to the decoder circuit 904 and selects gradation switches in accordance with the decoded image data. A gradation voltage generating circuit 908 has a plurality of resistors connected in series and generates a plurality of voltages suitable for use as the gradation voltages in the display apparatus. A buffer amplifier 909 converts the voltages generated by the gradation voltage generating circuit 908 by using a voltage follower circuit, and drives the data lines of the display apparatus through the gradation voltage selection circuit 905.

Because the voltage used to drive the display apparatus such as the liquid crystal display is generally higher than the voltage to be used in a logic circuit section such as the shift register circuit and the data latch circuit, the drive circuit needs to incorporate therein a level shift circuit. In this case, the level shift circuit is provided before or after the decoder circuit from the viewpoint of reduction in the number of bits of the image data and power consumption. For example, when the image data is of 6 bits ($2^6$=64 gradations) and the level shift circuit is disposed downstream (when viewing circuit components in a data stream direction) relative to the decoder circuit, [data latch circuit B], [decoder circuit (64× 6-input NAND)], and [64 level shift circuits] are arranged in this order, causing the drive circuit to have 64 level shift circuits. On the other hand, if the level shift circuit is arranged upstream relative to the decoder circuit, and [data latch circuit B], [level shift circuit (6)], and [decoder circuit] are arranged in this order, causing the drive circuit to have only 6 level shift circuits. Because large transient current flows through the level shift circuit, a display apparatus incorporated in such a way in a mobile phone is preferably designed to include as small number of level shift circuits as possible in terms of reduction in power consumption. Accordingly, when the image data is of 4 bits or more, the level shift circuit is generally disposed upstream relative to the decoder circuit.

However, when the level shift circuit is disposed upstream relative to the decoder circuit in this way, circuits to be disposed downstream relative to the level shift circuit need to be fabricated with high-voltage endurance. Therefore, a new problem arises in that the scale of drive circuit becomes large. In order to solve this problem, as shown in FIG. 2, it could be considered that bits of the image data are divided into three upper bits and three lower bits to make the circuit scale of the decoder circuit small. That is, 64 gradation switches 922 are controlled based on the three upper bits and are connected to the gradation voltages of V1 to V64 respectively. Eight gradations are selected from among the 64 gradations based on the three lower bits and one gradation is further selected from among the eight gradations based on the 3 upper bits. The decoder circuit is composed of (64+8) number of 3-input NAND circuits 920.

An example of a method of reducing the power consumption of the drive circuit would be a technique disclosed in Japanese Laid Open Patent Application (JP-P2002-108301A). In this conventional example, image data D0-D17 are determined and the power consumption of buffer amplifiers (voltage follower circuits) which are not used is reduced by an amplifier enable circuit. The image data are supplied in synchronism with a clock signal DCLK. FIG. 3 shows the detail when the technique for reducing the power consumption is applied to a gradation data determination circuit 906 shown in FIG. 1. The gradation data determination circuit 906 is composed of a decoder circuit 910 which is composed of three 6-input NAND circuits and one 3-input NAND circuit, and an RS latch circuit 911 which is connected to the decoder circuit. The reason why the three 6-input NAND circuits are used is that the image data is transferred in units of pixels and the image data has a 6-bit width to represent red, green, and blue for color display. When data is transferred in units of two pixels, the seven (=6+1) sets of 6-input NAND circuits are necessary. Because liquid crystal display device is not a device capable of emitting light and in addition, a drive voltage is the same irrespective of color to be displayed, 64 decoder circuits 910 and 64 RS latch circuits 911 are necessary. Signs of "00H" and "3FH" included in the decoder circuit and shown in FIG. 24 means that image data is represented by "000000=00H" and "111111=3FH" (hereinafter, in case of hexadecimal notation, H is added).

The gradation data determination circuit 906 is configured so that image data buses D0-D17 are connected to the decoder circuit 910 and the determination circuit 906 carries out determination in synchronism with a clock signal DCLK. For example, when even only one "00H" is inputted as image data to the circuit 906 during one horizontal period, the data "00H" is set in the RS latch circuit and the buffer amplifier corresponding to "00H" is set to an enable state by the amplifier enable circuit. If no "00H" is inputted thereto during the one horizontal period, the buffer amplifier corresponding to "00H" is set to a disable state, allowing reduction in the magnitude of current consumed in the buffer amplifier. This determination is carried out every horizontal period and a reset signal is supplied every horizontal period to initialize the data contained in the RS latch circuit. In this way, determining the value of image data in synchronism with the clock signal DCLK to set the buffer amplifier corresponding to a gradation, which is not used during the corresponding horizontal period, to the disable state helps to reduce the consumption current.

In such a technique, the image data is always latched in a line memory (the data latch circuit A and the data latch circuit B) in synchronism with a signal from the CPU. Also, the determination of the image data is carried out in synchronism with the signal from the CPU. However, a portable phone displays a still image in most of the cases and therefore is configured so that a data drive circuit section includes a frame memory and CPU sends image data only when frame image is changed, in order to reduce power consumption. For this reason, a control signal for control of drive circuit and a signal from the CPU are made asynchronous. In other words, a clock signal and image data are supplied only when an image to be displayed is changed. However, in order to display an image, the image data must be driven in a constant period asynchronous with a signal from the CPU. The image data are transferred from the frame memory to the line memory all at once in response to a latch signal having the constant period.

Therefore, it is necessary to determine the image data stored in the line memory all at once. However, the conventional technique cannot provide a method for determining image data stored in the line memory all at once.

In conjunction with the above description, a drive circuit of a liquid crystal display is disclosed in Japanese Laid Open Patent Application (JP-P2001-272655A). In this conventional example, one is selected from gradation voltages for $2^n$ gradations to a positive polarity and a negative polarity to a common voltage as a drive voltage of data lines of a liquid crystal panel based on n-bit digital data signal by using an A/D converter. A drive capability is increased by an operational amplifier of a voltage follower connection which can output a rising waveform and a falling waveform, and the gradation voltage is outputted from an output terminal. When the polarity of this output changes every a predetermined period, the output terminal is connected to the common voltage. The input of the operational amplifier is set as the gradation voltage for the next polarity in which the current flowing through the operational amplifier becomes the smallest during a period from when the output terminal is connected to the common voltage to when the next gradation voltage for the next polarity is selected by the D/A converter.

Also, a drive apparatus of a liquid crystal display is disclosed in Japanese Laid Open Patent Application (JP-P2001-343944A). In this conventional example, k-bit data signal corresponding to data lines of a liquid crystal panel is converted to a desired one of $2^k$ gradation voltages by a D/A converter which is alternately switched between a positive polarity and a negative polarity for every scan of the data lines. The drive capability of the gradation voltage is increased by a voltage follower output circuit, and the gradation voltage is outputted to the data lines. A logical process is applied to the data signal for n-th scanning and the data signal for (n+1)-th scanning, and the through rate of the voltage follower output circuit in the (n+1)-th scanning is changed in accordance with the logical process result.

Also, a drive circuit of a liquid crystal display is disclosed in Japanese Laid Open Patent Application (JP-P2002-215108A). In this conventional example, a digital video image data is outputted as it is or is outputted after inversion based on a polarity signal which is inverted for every horizontal synchronization period or vertical synchronization period. A group of gradation voltages for the positive polarity and a group of gradation voltages for the negative polarity are predetermined to fit with the transmittivity characteristic to the positive application voltage and the transmittivity characteristic to the negative application voltage in the liquid crystal display, and one is selected from the above groups based on the polarity signal. One is selected from among the gradation voltages of the selected group based on the digital video image data or the inverted digital video image data, and the selected gradation voltage is applied to a corresponding data electrode.

Also, a drive circuit is disclosed in Japanese Laid Open Patent Application (JP-P2002-366106A). In this conventional example, a scanning line inversion drive is carried out to set a voltage level in a scanning period of a counter electrode opposing to a pixel electrode through electro-optical substance to a voltage level different from that in a previous scanning period. In the M-th scanning period, the voltage level of the counter electrode is set to one of first and second voltage levels. In a virtual scanning period next to the M-th scanning period, the voltage level of the counter electrode is set to the other of the first and second voltage levels. In the first scan period after the virtual scanning period, the voltage level of the counter electrode is set to the one voltage level of the first and second voltage levels.

SUMMARY OF THE INVENTION

Therefore, an object of the present invention is to provide a drive circuit of a display apparatus, in which it possible to reduce power consumption of the drive circuit.

Another object of the present invention is to provide a drive circuit of a display apparatus, in which power consumption of the drive circuit can be reduced by using gradations of image data in a previous line.

Another object of the present invention is to provide a drive circuit of a display apparatus, in which the drive circuit has a frame memory and power consumption of the drive circuit can be reduced when a video image is displayed, in addition to a still image display.

In an aspect of the present invention, a drive circuit of a display apparatus in which a plurality of scanning lines and a plurality of data lines are orthogonalized, include a first data latch circuit which latches image data for every line in response to a horizontal signal; a decoder circuit which decodes the latched image data; and a gradation voltage selection circuit which selects voltage lines based on the decoded image data, to connect each of the plurality of data lines with any of the voltages lines. The drive circuit further includes a data determination circuit which generates determination signals based on the selected voltage lines such that each of a plurality of gradation amplifiers is selectively set to an inactive state based on the determination signal; a gradation amplifier circuit which may include the plurality of gradation amplifiers, each of which amplifies a corresponding one of gradation voltages when being in an active state and does not amplify the corresponding gradation voltage when being in an inactive state, the amplified gradation voltage being outputted on a corresponding one of the voltage lines; and an output circuit which drives the plurality of data lines based on the amplified gradation voltages on the voltage lines.

Here, the drive circuit may further include a bias control circuit which sets each of the plurality of gradation amplifiers to the active state or the inactive state based on the determination signals from the data determination circuit.

Also, the drive circuit may further include a frame memory which stores the image data for one frame; and a second latch circuit which latches the image data for one line in response to a latch signal, to output to the first latch circuit. In this case, the drive circuit may further include a data switching circuit which outputs input image data to the frame memory when the input image data is video image data, and outputs the input image data to the second latch circuit when the input image data is still image data.

Also, the drive circuit may further include a gradation voltage generating circuit which generates a plurality of voltages; and a polarity switching circuit which is provided between the gradation voltage generating circuit and the gradation amplifier circuit to select the gradation voltages from the plurality of voltages generated by the gradation voltage generating circuit in response to a polarity signal. In this case, the data determination circuit may operate in response to the horizontal signal or in response to the horizontal signal and the polarity signal.

Also, the gradation voltage selection circuit may include a plurality of gradation selection switches which select one of the voltage lines for each of the plurality of data lines based on the decoded image data; and a first switch which is provided for each of the plurality of gradation selection switches to connect an input terminal of each of the plurality of gradation selection switches with a higher voltage or a lower voltage power supply. Also, the output circuit may include a second switch which is provided for each of the plurality of gradation selection switches to connect an output terminal of each of the plurality of gradation selection switches with the lower voltage or the higher voltage; and a third switch which is provided for each of the plurality of gradation selection switches to switch between the output terminal of each of the plurality of gradation selection switches and the output circuit. At this time, the data determination circuit generates the determination signals based on a voltage on each of the voltage lines. In this case, the drive circuit may further include a command control circuit which always sets the third switches which are not connected to the plurality of data lines of the display apparatus to an off state when the number of pixels of the frame memory is more than the number of pixels of the display apparatus.

Also, the gradation voltage selection circuit may include a plurality of gradation selection switches which select one the voltage lines for each of the plurality of data lines based on the decoded image data; a first switch which is provided for each of the plurality of gradation selection switches to connect an input terminal of each of the plurality of gradation selection switches with a higher voltage; and a second switch which is provided for each of the plurality of gradation selection switches to connect the input terminal of each of the plurality of gradation selection switches with a lower voltage. Also, the output circuit may include a third switch which is provided for each of the plurality of gradation selection switches to connect an output terminal of each of the plurality of gradation selection switches with the lower voltage; a fourth switch which is provided for each of the plurality of gradation selection switches to connect the output terminal of each of the plurality of gradation selection switches with the higher voltage; and a fifth switch (206) which is provided for each of the plurality of gradation selection switches to switch between the output terminal of each of the plurality of gradation selection switches and the output circuit. At this time, the data determination circuit generates the determination signals based on an output voltage of each of the plurality of gradation selection switches. In this case, the drive circuit may further include a command control circuit which always sets the third and fifth switches which are not connected to the plurality of data lines of the display apparatus to an off state when the number of pixels of the frame memory is more than the number of pixels of the display apparatus.

Also, the drive circuit may further include the gradation voltage selection circuit sets the plurality of gradation amplifiers to the inactive state during a period during which there are not the plurality of scanning lines corresponding to the image data, when the number of pixels of the frame memory is more than the number of pixels of the display apparatus.

Also, the data determination circuit may include a counter which is provided to count the gradation voltages selected by the gradation voltage selection circuit. The data determination circuit may change a period during which each of the plurality of gradation amplifiers is in the active state based on a count value of the counter such that the period is shorter as the count value is less.

Also, each of the plurality of gradation amplifiers may include a constant current source, and an output stage. The data determination circuit sets a current value of the constant current source to 0 when the gradation amplifier is in the inactive state, and the output stage to a high impedance state.

Also, the gradation amplifier circuit may include a first group of gradation amplifiers, each of which has N-channel transistors as differential input transistors; and a second group of gradation amplifiers, each of which has P-channel transistors as the differential input transistors.

DESCRIPTION OF THE PREFERRED EMBODIMENTS

Hereinafter, a drive circuit of a display apparatus will be described in detail with reference to the attached drawings.

First Embodiment

Figure 4:
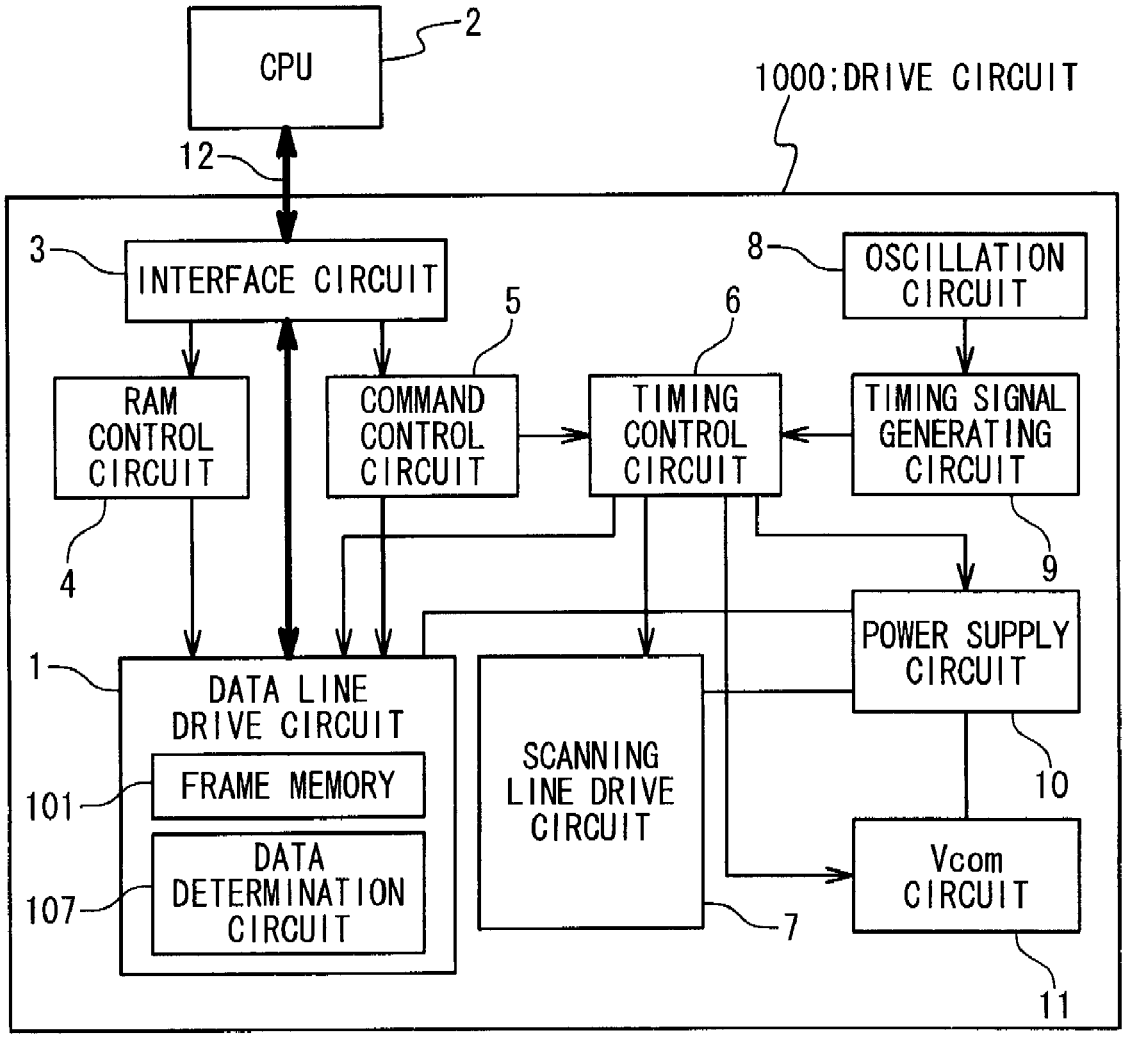
FIG. 4 is a block diagram of a display apparatus to which the present invention is applied.

FIG. 4 is a block diagram showing the configuration of a display apparatus, e.g., a liquid crystal display device to which the present invention is applied. A display apparatus 1000 used for a portable phone, etc. is connected to a CPU 2, and displays an image in response to a signal 12 from the CPU 2. Though not shown in the figure, the display apparatus 1000 includes a display unit having a plurality of scanning lines and a plurality of data lines arranged in a matrix of rows and columns. The display apparatus 1000 contains a data line drive circuit 1, an interface circuit 3, a RAM control circuit 4, a command control circuit 5, a timing control circuit 6, a scanning line drive circuit 7, an oscillation circuit 8 a timing generating circuit 9, a power supply circuit 10, and a Vcom circuit 11.

The data line drive circuit 1 drives the data lines of the display unit and contains a later-described frame memory 101 and a data determination circuit 107. The interface circuit 3 is connected to the CPU 2 to interface. The RAM control circuit 4 is connected to the interface circuit 3 and the drive circuit 1. The RAM control circuit 4 controls a write address of the frame memory 101 and so on. The command control circuit 5 is connected to the interface circuit 3, the drive circuit 1 and the timing control circuit 6. The command control circuit 5 inputs data necessary to drive the display unit such as setting data in a gamma circuit and a drive frequency, a drive voltage and the number of pixels of the frame memory 101 from the CPU 2 via the interface circuit 3, and holds data written in an EEPROM (not shown) therein. The command control circuit 5 controls the drive circuit 1 and the timing control circuit 6.

The oscillation circuit 8 generates a clock signal RCLK asynchronous with the signal supplied from the CPU 2. The timing generating circuit 9 generates signals such as a vertical signal VS, a horizontal signal STB and a polarity signal POL necessary to drive the display unit based on the clock signal supplied from the oscillation circuit 8. The timing control circuit 6 generates timing signals to control drive timings of the display unit, and the drive timings are supplies to the data line drive circuit 1, the scanning line drive circuit 7, the power supply circuit 10, and the Vcom circuit 11. The power supply circuit 10 generates voltages for the display apparatus 1000 in response to the drive timing from the timing control circuit and supplies to various sections such as the data line drive circuit 1, the scanning line drive circuit 7 and the Vcom circuit 11. The voltages used are generated by the power supply circuit 10 to drive the data lines, the scanning lines and the common electrodes of the display unit. The Vcom circuit 11 drives common electrodes in accordance with the drive timing from the timing control circuit using the voltages. The scanning line drive circuit 7 drives the scanning lines in response to the drive timing.

It should be noted that the above circuits are not always necessarily formed on the same substrate or a circuit board. The power supply circuit 10, the scanning line drive circuit 7 and the Vcom circuit 11 may be formed on another substrate or board. Also, a part or the whole of the circuits may be manufactured on a glass substrate.

Also, it should be noted that power supply lines for logic circuit sections such as the oscillation circuit 8 and the interface circuit 3 are not shown in FIG. 4. Also, although in addition to data signals D0 to D17 for image data and command data, the signal 12 supplied from the CPU would include a chip select signal, a write signal, a read signal, a data/command selection signal, a reset signal and so on, all the signals are collectively shown as the signal 12.

Next, the data line drive circuit 1 containing the frame memory 101 will be described with reference to FIG. 5. The frame memory 101 can store image data for one frame, and still image data supplied from the CPU 2 is written in the frame memory 101. The image data for one line stored in the frame memory 101 is transferred to a data latch circuit A 102 all at once in response to a latch signal LAT from the timing control circuit 6. When a write signal supplied from the CPU 2 and the latch signal LAT overlap in timing, a write instruction from the CPU 2 to write to the frame memory 101 is carried out with a higher priority. The image data latched in the data latch circuit A 102 is transferred all at once to and latched by the data latch circuit B 103 in response to the horizontal signal STB and a polarity signal POL, and is held for a current horizontal period.

The image data latched in the data latch circuit B 103 is decoded by a decoder circuit 104 which is composed of such as NAND circuits for a level shift circuit. A gradation voltage generation circuit 109 generates a plurality of voltages. A polarity switching circuit 110 is provided so that a certain voltage to be output from the circuit 110 is switched between a group of positive gamma voltages and a group of negative gamma voltages in response to a polarity signal POL, in order to output the certain voltage as gradation voltages. A gradation amplifier circuit 111 contains a plurality of gradation amplifiers which amplify the gradation voltages from the polarity switching circuit 110, and the amplified gradation voltages are supplied to a gradation voltage selection circuit 105. The gradation voltage selection circuit 105*a* contains a plurality of gradation selection switches. The gradation selection switches are activated in accordance with the decoded image data from the decoder circuit. The amplified gradation voltages corresponding to the activated gradation selection switches are outputted to an output circuit 106 and are used to drive the data lines.

A data determination circuit 107 generates determination signals for a current horizontal period from the amplified gradation voltages corresponding to the activated gradation selection switches for the current horizontal period. A bias control circuit 108 controls the gradation amplifiers of the gradation amplifier circuit 111 based on the determination signals during the current horizontal period.

More specifically, the gradation voltage generation circuit 109 contains a resistor string circuit in which a plurality of resistors are connected in series. The gradation voltage generation circuit 109 generates a plurality of voltages using the resistor string circuit to allow the voltages to fit to the gamma characteristic of the display unit. Generally, the liquid crystal display needs to be alternately driven for prevention of degradation of liquid crystal. For this reason, a positive voltage and a negative voltage are alternately applied to the common electrode of the liquid crystal display and the polarity of a voltage to be applied is changed in a predetermined period. Because a gradation voltage of positive polarity and a gradation voltage of negative polarity to represent the same light intensity are slightly different from each other as indicated by the voltage characteristic shown in FIGS. 6A to 6D, the polarity switching circuit 110 is provided to allow a gradation voltage to switch between the positive gamma voltages and the negative gamma voltages. The gradation voltage generation circuit 109 and the polarity switching circuit 110 make up voltage generation means. The plurality of gradation voltages from the polarity switching circuit 110 are amplified respectively by the plurality of gradation amplifiers 111 of the gradation amplifier circuit 111 and are supplied to the gradation voltage selection circuit 105.

Here, in case of the display unit of the mobile phone, when a still image such as a photograph is displayed, the CPU 2 does not necessarily always transfer image data, but may transfer the data only when the image changes. In this way, because whether the image data 12 from the CPU 2 is inputted to the drive circuit or not is random, the signal used in a drive circuit system needs to be asynchronous with the signal 12 from the CPU 2. For this reason, a clock signal of the drive circuit system is generated by the oscillation circuit 8 which is composed of a capacitor and a resistor. Signals such as the horizontal signal STB, the vertical signal VS, the latch signal LAT, the polarity signal POL which are necessary to drive the display unit are generated by the timing generating circuit 9 based on the clock signal from the oscillation circuit 8.

Figure 7:
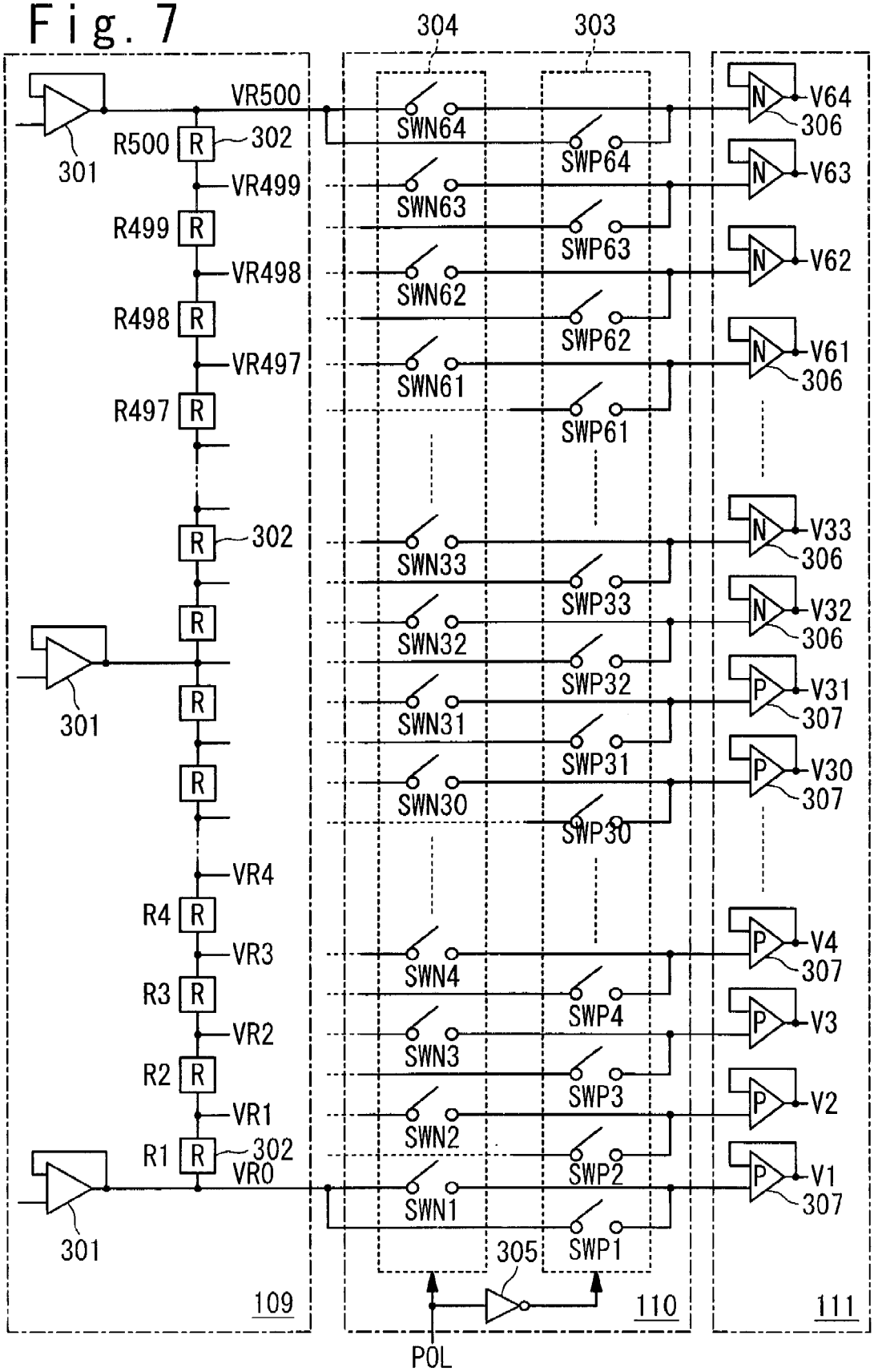
FIG. 7 is a diagram showing the structure of a gradation voltage generating circuit and a gradation amplifier circuit in the first embodiment.

FIG. 7 shows the configuration of the gradation voltage generation circuit 109, the polarity switching circuit 110 and the gradation amplifier circuit 111. Here, the gradation voltage generation circuit 109 includes 500 resistors R1 to R500 with the same resistance and input buffers 301. The resistors R1 to R500 are connected in series and the input buffers 301 are connected between some of connection nodes of the resistors. Individual voltages can be obtained from individual connection nodes. For example, provided that the voltage VR500 at the connection node of the resistor R500 is 5 V and the voltage VR0 at the connection node of the resistor R0 is 0 V, a voltage difference between adjacent connection nodes is 10 mV (=5V/500) and a voltage VR at n-th connection point is n×10 mV.

The polarity switching circuit 110 is composed of a switching unit 303 having 64 switches for supply of positive voltages and a switching unit 304 having 64 switches for supply of negative voltages. The polarity switching circuit 110 connects 64 predetermined voltages chosen out of the 500 voltages generated by the gradation voltage generation circuit 109 to the input terminals of each of the switch units 303 and 304 to allow the 64 predetermined voltages to fit the gamma characteristic of liquid crystal. The polarity switching circuit 110 operates so that when the polarity signal POL is "H", the switches SWP1 to SWP64 of the switching unit 303 are turned on and the switches SWN1 to SWN64 in the switching unit 304 are turned off. Likewise, when the polarity signal POL is "L", the switches SWP1 to SWP64 of the switching unit 303 are turned off, and the switches SWN1 to SWN64 of the switching unit 304 are turned on. The 64 selected voltages are supplied to the gradation amplifier circuit 111.

Figure 8A:
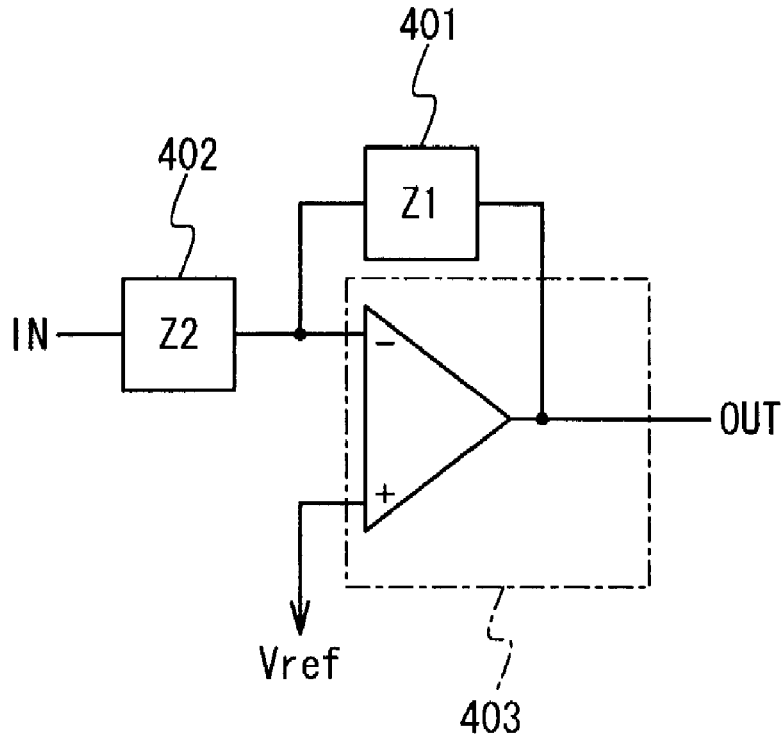
FIG. 8A is a circuit diagram showing an equivalent circuit of a gradation amplifier with a gain larger than 1 in the gradation amplifier circuit.
Figure 8B:
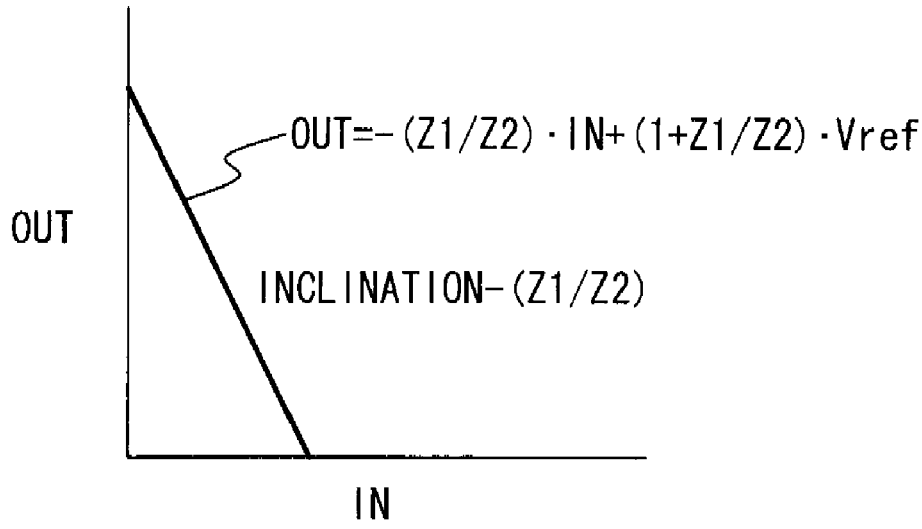
FIG. 8B is a graph of input-output characteristic of the gradation amplifier.

The gradation amplifier circuit 111 may be composed of the plurality of gradation amplifiers and may include 64 ($=2^6$) gradation amplifiers when the image data is 6 bits. Each of the gradation amplifiers may be of a voltage follower type (with the gain of one). However, the gradation amplifier 111 does not need to be of a voltage follower type. In this example, each of the gradation amplifiers is constituted by an operational amplifier 403 with loads 401 and 402 and has a gain larger than one, as shown in FIGS. 8A and 8B. Also, the gradation amplifiers are grouped into a group of gradation amplifiers 306 and a group of gradation amplifiers 307. The gradation amplifier 306 has a circuit configuration shown in FIG. 9A and an input-output characteristic shown in FIG. 9B. FIG. 9C shows an equivalent circuit of the gradation amplifier 306. As seen from FIG. 9A, N-channel transistors Q1 and Q2 are used for input transistors of a differential stage in the gradation amplifier 306. The gradation amplifier 307 has a circuit configuration shown in FIG. 10A and an input-output characteristic shown in FIG. 10B. FIG. 10C shows an equivalent circuit of the gradation amplifier 307. As seen from FIG. 10A, P-channel transistors Q11 and Q12 are used for input transistors of a differential stage in the gradation amplifier 307. If the input transistors at the differential stage are of an N-channel type, the dynamic range can be secured on the higher voltage side indicated by the input-output characteristic shown in FIG. 9B. Also, if the input transistors of the differential stage are of a P-channel type, the dynamic range can be secured on the low voltage side indicated by the input-output characteristic shown by in FIG. 10B. Therefore, the gradation amplifier circuit 111 consuming low power can be formed, using two types of amplifiers. As described above, generally, the gradation amplifier circuit 111 includes $2^m$ gradation amplifiers when the image data is m bits, and these $2^m$ gradation amplifiers are constituted by k (k is an integer more than 0) number of N-channel gradation amplifiers 306 and the $2^m$-k number of P-channel gradation amplifiers 307.

Figure 5:
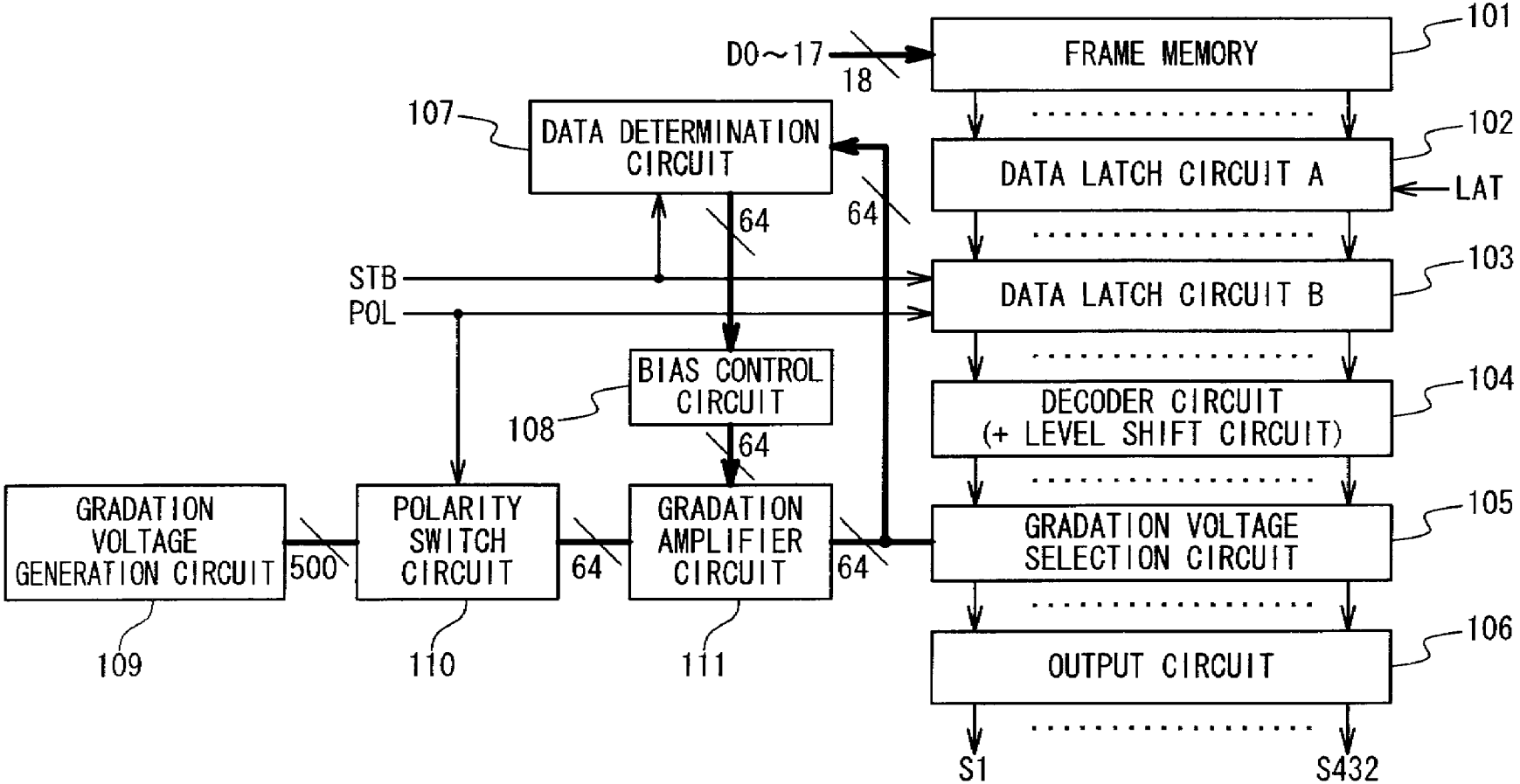
FIG. 5 is a block diagram showing a data line drive circuit according to a first embodiment of the present invention.
Figures 6A, 6B, 6C, 6D:
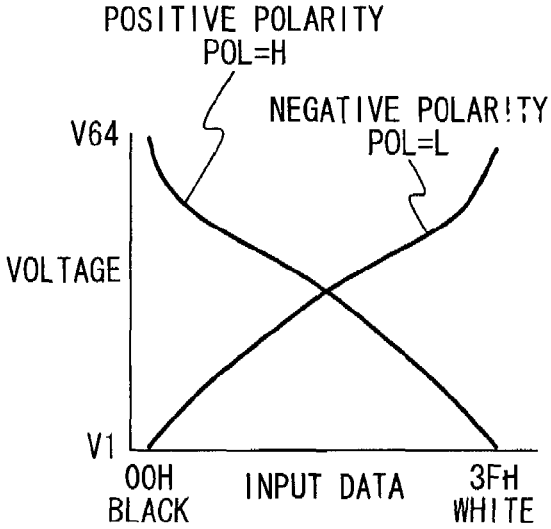
FIG. 6A is a diagram showing a relation between image data and output voltage for positive polarity and negative polarity in the first embodiment.
FIG. 6B is a graph showing relations between image data and output voltage for positive polarity and negative polarity in the first embodiment.
FIG. 6C is a table showing relations between gradation amplifiers and output voltage for positive polarity and negative polarity in the first embodiment.
FIG. 6D is a diagram showing relations between image data and gradation in the first embodiment.
Figure 11:
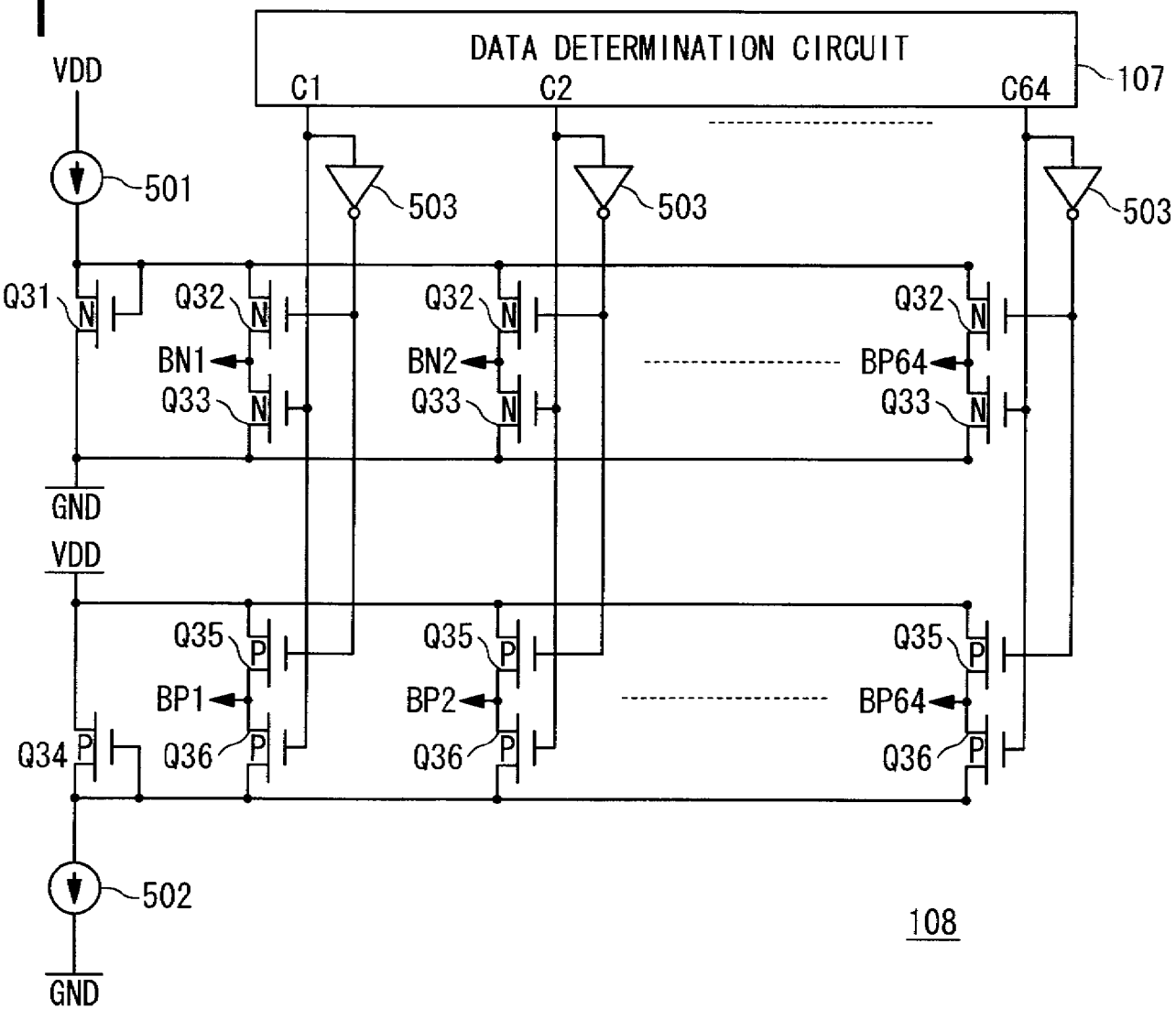
FIG. 11 is a circuit diagram showing a bias current control circuit.

The bias control circuit 108 shown in FIG. 5 is provided to control current supplied by a constant current source of each of the gradation amplifiers 306 and 307. As shown in FIG. 11, the bias control circuit 108 is composed of a constant current source 501, an N-channel transistor Q31 and 64 sets of N-channel transistors Q32 and Q33 on the N-channel side and a constant current source 502, a P-channel transistor Q34 and 64 sets of P-channel transistors Q35 and Q36 on the P-channel side, and 64 inverters 503. Each of the 64 determination signals from the data determination circuit is connected to the gates of the N-channel transistors Q33 and the gates of the P-channel transistors Q36. Each of the 64 determination signals inverted by the inverters 503 is connected to the gates of the N-channel transistors Q32 and the gates of the P-channel transistors Q35. In this way, the bias control circuit 108 individually controls a current value of each of the 64 constant current sources in each of the gradation amplifiers 306 and 307 based on the determination signals from the data determination circuit 107. The bias control circuit 108 has bias terminals BNn (n=1, 2, . . . , 64) as nodes between the N-channel transistors Q32 and Q33 and bias terminals BPn (n=1, 2, . . . , 64) between the P-channel transistors Q35 and Q36. The bias terminal BNn is connected to the gate of the constant current source transistor Q5 of each gradation amplifier 306, and the bias terminal BPn is connected to the gate of the constant current source transistor Q15 of each gradation amplifier 307. When determination signal Cn (n=1, 2, . . . , 64) from the data determination circuit 107 is "H", the voltage of the terminal BNn is GND and the voltage of the terminal BPn is VDD in the bias control circuit 108, allowing the individual amplifiers to be inactive. When the determination signal Cn (n=1, 2, . . . , 64) is "L", the voltage of the terminal BNn is set to a predetermined voltage N and the voltage of the terminal BPn is set to a predetermined voltage P. Thus, current of a predetermined magnitude flows through the constant current source of each of the gradation amplifiers 306 and 307, allowing the amplifiers to be active.

Figure 9A:
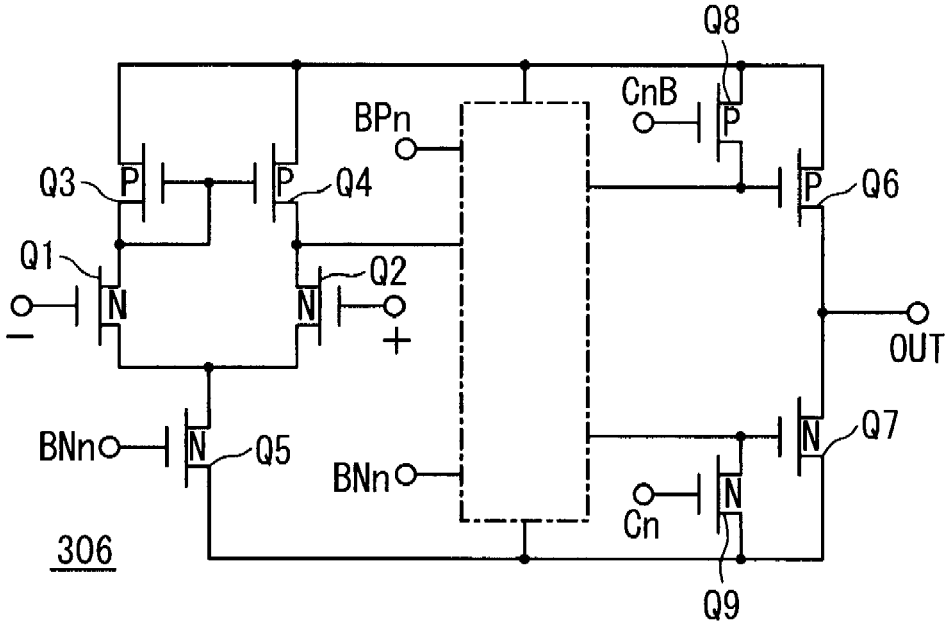
FIG. 9A is a circuit diagram showing a first gradation amplifier.
Figure 9B:
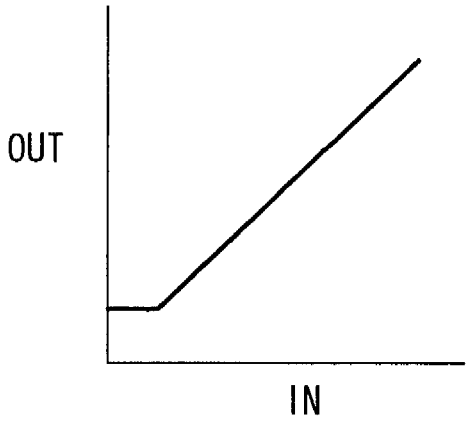
FIG. 9B is a graph showing the input-output characteristic of the first gradation amplifier.
Figure 9C:
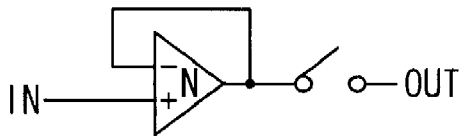
FIG. 9C is a diagram showing an equivalent circuit of the first gradation amplifier.
Figure 10A:
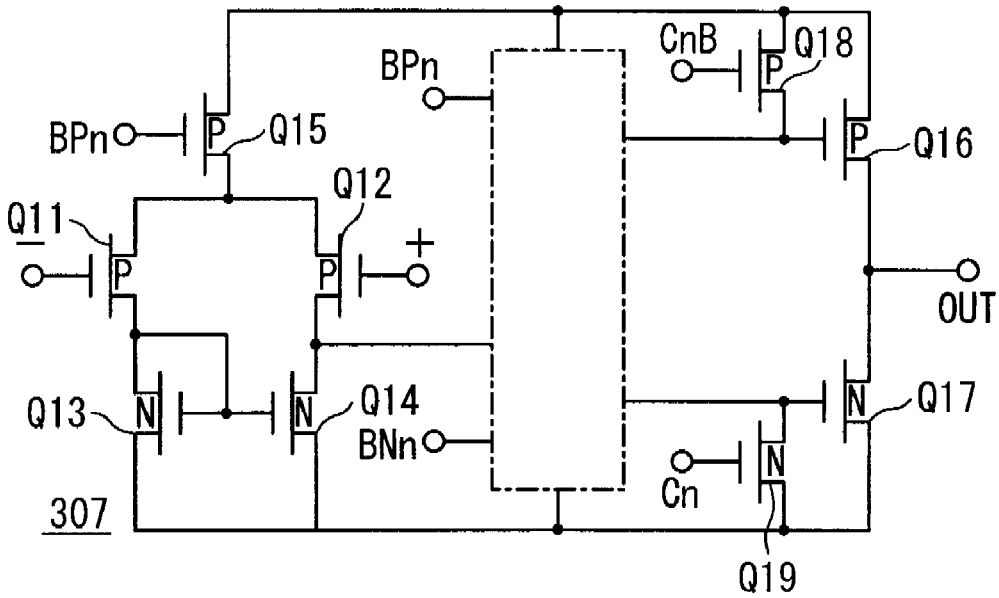
FIG. 10A is a circuit diagram showing a second gradation amplifier.
Figure 10B:
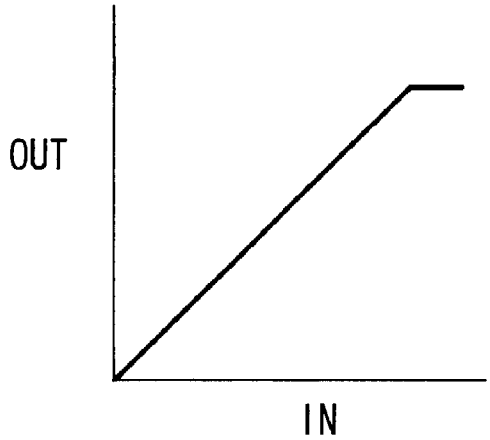
FIG. 10B is a graph showing the input-output characteristic of the second gradation amplifier.
Figure 10C:
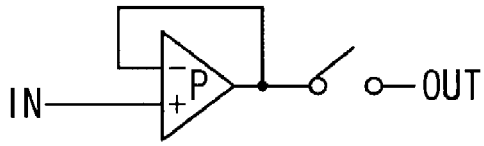
FIG. 10C is a diagram showing an equivalent circuit of the second gradation amplifier.

The output stage of each of the gradation amplifiers 306 and 307 contains a P-channel transistors (Q6 or Q16) and a N-channel transistors (Q7 or Q17), as shown in FIGS. 9A and 10A. In order to set each of the gradation amplifiers 306 and 307 to the inactive state, the determination signal Cn supplied from the data determination circuit 107 to the bias control circuit 108 is set to "H", and a signal CnB is set to "L" (CnB means an inverted signal of the determination signal Cn). In this state, the transistor Q8 turns on so that the gate voltage of the transistor Q6 becomes VDD, resulting in the transistor Q6 turning off. Also, the transistor Q9 turns on so that the gate voltage of the transistor Q7 becomes GND, resulting in the transistor Q7 turning off. Therefore, the output of the output stage becomes a high impedance state. Also, the gate voltage BNn of the constant current source Q5 becomes GND and the current value of constant current source Q5 becomes 0. Therefore, the N-channel gradation amplifier 306 becomes an inactive state. In the same way, the transistor Q18 turns on so that the gate voltage of the transistor Q16 becomes VDD, resulting in the transistor Q16 turning off. Also, the transistor Q19 turns on, so that the gate voltage of the transistor Q17 becomes GND, resulting in the transistor Q17 turning off. Therefore, the output of the output stage becomes a high impedance state. The gate voltage BPn of the constant current source Q15 becomes VDD, so that the current value of constant current source Q15 becomes 0, and the P-channel gradation amplifier becomes an inactive state. In this way, the gradation amplifier can be set to the inactive state based on the determination signal.

Figure 12:
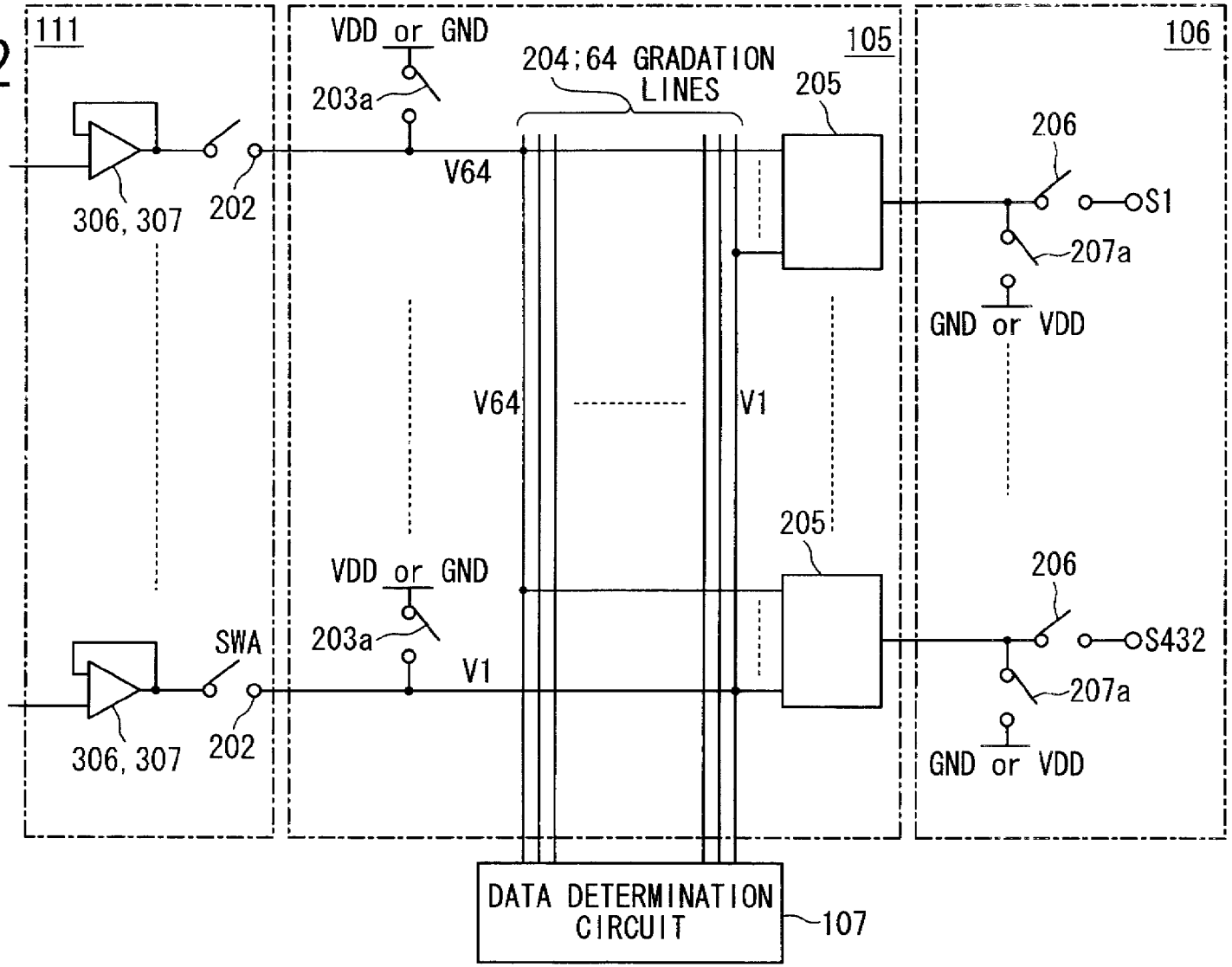
FIG. 12 is a block diagram of a data determination circuit according to the first embodiment of the present invention.

FIG. 12 shows the gradation amplifier circuit 111, the gradation voltage selection circuit 105 and the output circuit 106. The gradation amplifier circuit 111 is composed of a plurality of gradation amplifiers. Each of a plurality of switches 202 is a part of the gradation amplifier, as shown in the equivalent circuits of FIGS. 9C and 10C. The gradation voltage selection circuit 105 is composed of 64 gradation lines 204, switches 203*a* and gradation selection switches 205. The gradation lines 204 are connected to output terminals 202 of the gradation amplifiers 306 and 307 (refer to FIGS. 9A and 10A) in the gradation amplifier circuit 111. The switches 203*a* are connected to the respective gradation lines 204. Each of the gradation selection switches 205 is composed of 64 analog switches and is connected to the gradation lines 204. Also, the gradation lines 204 are connected to the data determination circuit 107. The output circuit 106 is composed of switches 206 and switches 207*a*. It would be apparent to those skilled in the art that the present driving circuit may be configured to include the switches 207*a* in the gradation voltage selection circuit 105 instead of the output circuit 106. The switches 206 are provided between the data lines of the display unit and the output of the gradation selection switches 205. The switches 207*a* are provided between the outputs of the gradation selection switches 205 and supplies the voltage of GND or VDD. In the embodiment, all the switches 203*a* are connected to VDD and all the switches 207*a* are connected to GND, or all the switches 203*a* are connected to GND and all the switches 207*a* are connected to VDD. If the switches 203*a* and the switches 207*a* are connected to the same voltage supply, a potential change at each of the gradation lines 204 cannot be detected.

Here, the data determination circuit 107 carries out the data determination in cooperation with the decoder circuit 104, the gradation voltage selection circuit 105 and the output circuit 106.

This data determination operation will be described with reference to an operation state diagram of FIGS. 13A to 13D and timing charts of FIGS. 14A to 14G. For simplification, it is assumed that only the gradation selection switch 205 is turned on to allow connection between an optional gradation line Vn and the data line S1, as shown in FIGS. 13A to 13D. As described above, actually, the gradation selection switch 205 is composed of 64 analog switches and there are 64 gradation lines.

Figure 13A:
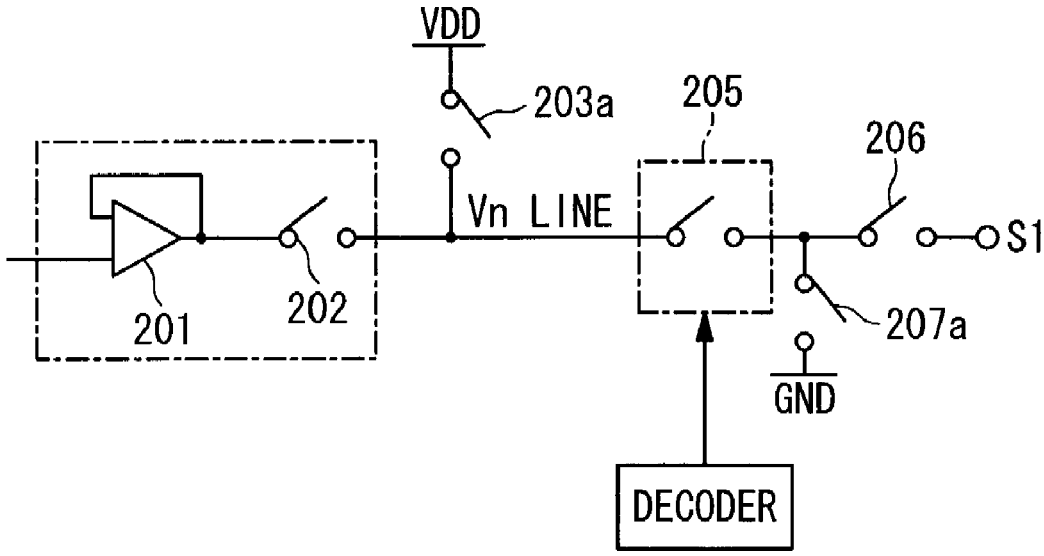
FIGS. 13A to 13D are circuit diagrams showing how switches are operated in a data determination process in the first embodiment.
Figure 13B:
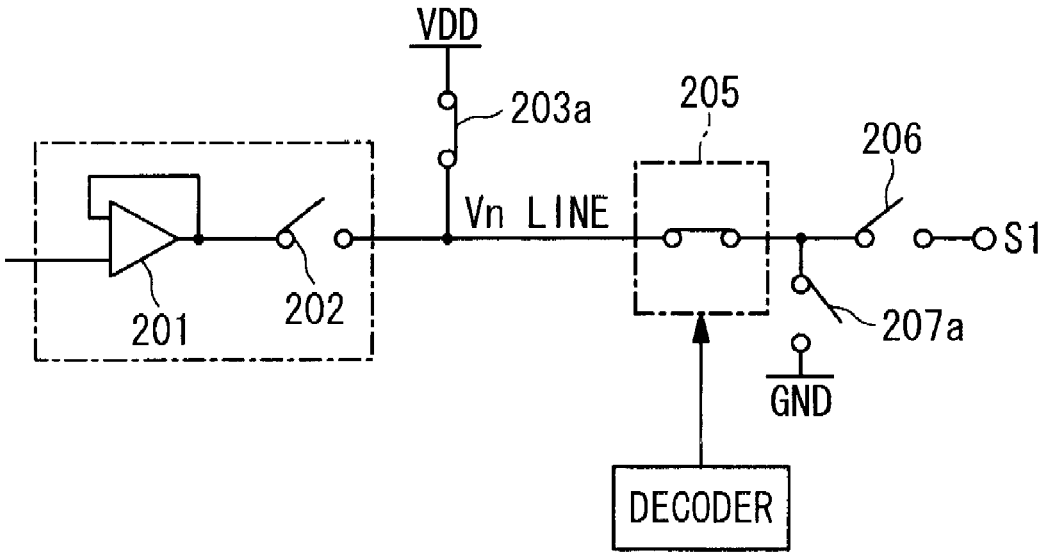
Figure 13C:
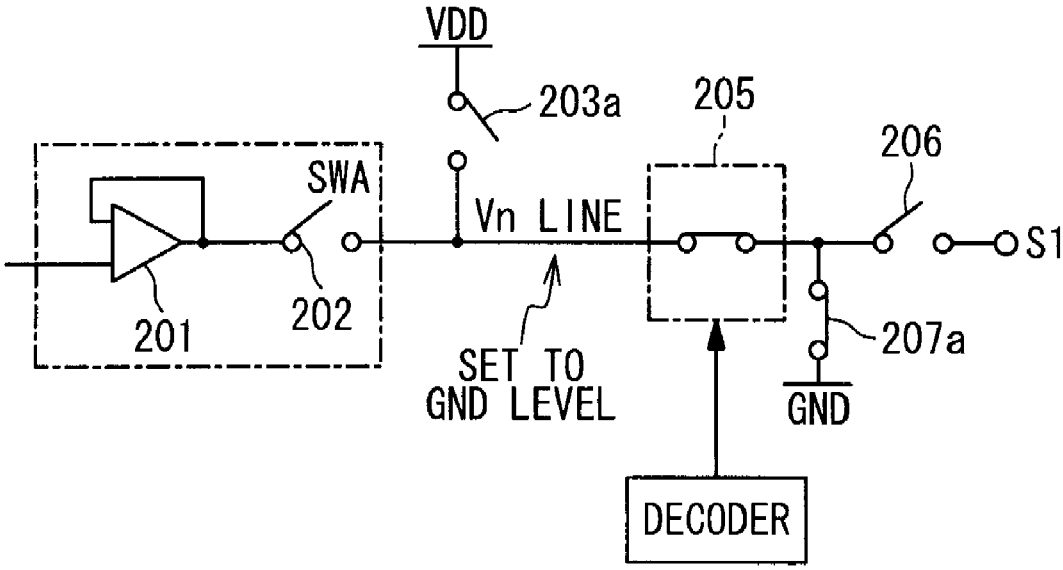
Figure 13D:
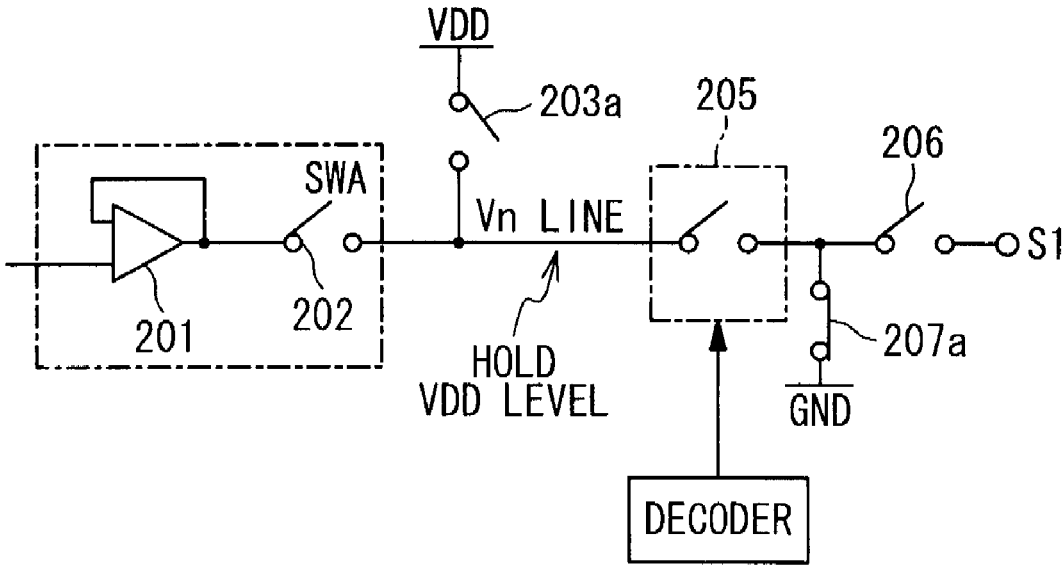
Figures 14A, 14B, 14C, 14D, 14E, 14F, 14G:
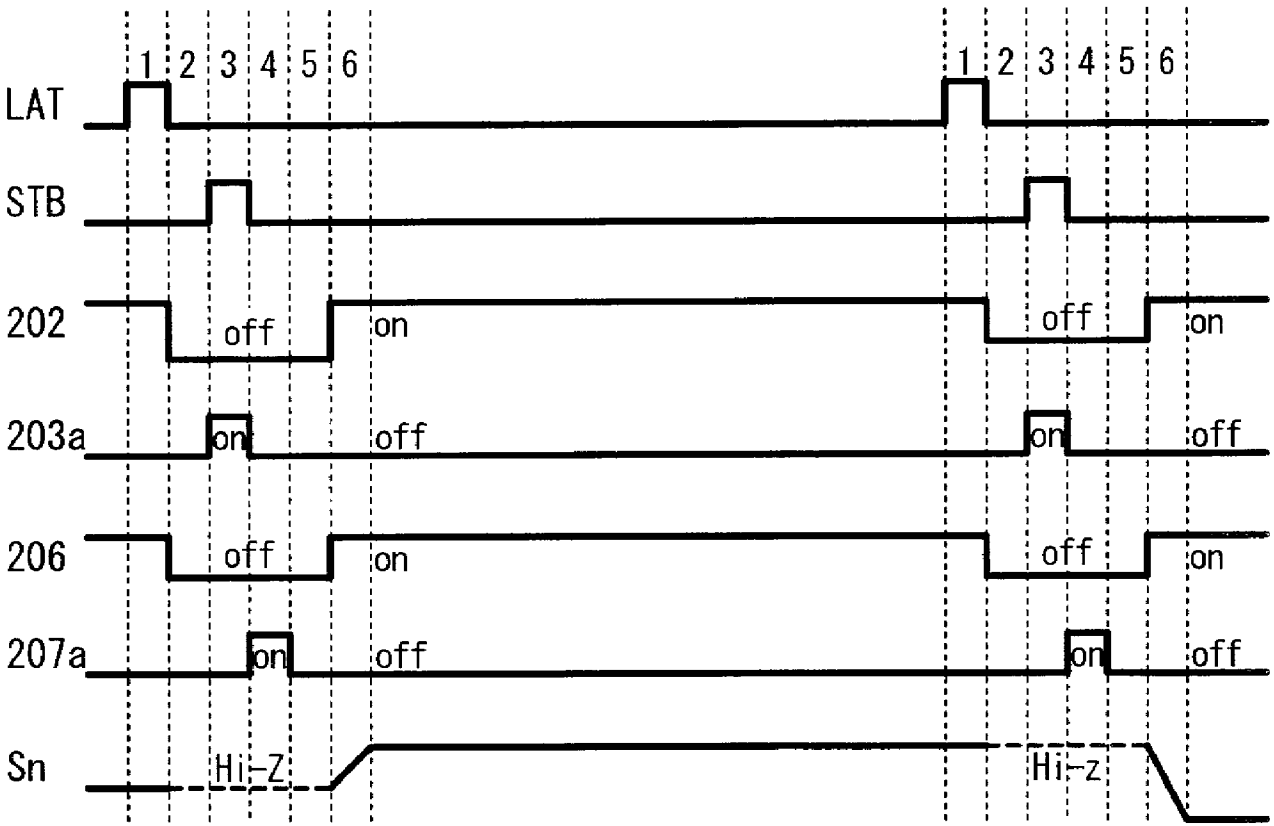
FIGS. 14A to 14G are timing charts in the data determination process in the display apparatus of the first embodiment.

At the time t1 in FIGS. 14A to 14G, the image data read out from the frame memory 101 is transferred to and latched by the data latch circuit A 102 in response to the latch signal LAT. Next, the above-mentioned determination signals Cn are all set to "H" regardless of the image data at the time t2 in FIGS. 14A to 14G in response to a timing signal from the time control circuit 6. As a result, all the switches 202 are turned off and all the gradation amplifiers 201 are set to an inactive state. FIG. 13A shows the states of the switches in this case. The reason why the switch 206 is set to an off state is to prevent the data line of the display unit from being driven by the voltage of the corresponding gradation line during the data determination process. At the time t3 in FIGS. 14A to 14G, the image data is transferred from the data latch circuit A 102 to the data latch circuit B 103 in response to the horizontal signal STB, and is latched therein. The decoder circuit 104 decodes the image data latched in the data latch circuit B 103. The switches 203*a* are turned on to precharge or pull up all of the gradation lines 204 to the voltage supply VDD in response to a timing signal from the time control circuit 6. At this point, one of the gradation selection switches 205 is turned on based on the image data that is decoded by the decoder circuit 104 in response to the timing signal from the time control circuit 6. FIG. 13B shows the states of the switches. At the time t4 in FIGS. 14A to 14G, all of the switches 203*a* are turned off and then all of the switches 207*a* are turned on in response to a timing signal from the time control circuit 6. As a result, only the gradation line 204 corresponding to the gradation selection switch 205 being turned on is set to the level of GND, and the gradation lines 204 corresponding to the gradation selection switches 205 being turned off hold the level of VDD. FIGS. 13C and 13D show how the switches operate. The data determination circuit 107 contains latch circuits (not shown), and latches the voltage level of each of the 64 gradation lines 204 as "1" when the gradation line 204 holds the level of VDD and "0" when the gradation line 204 holds the level of GND at the time t4 in FIGS. 14A to 14G. In order to prevent malfunction of the data determination circuit 107 due to noise which is generated by, for example, a signal from the CPU 2 during determination of image data, a capacitor, though not shown, is connected to each gradation line.

Next, all of the switches 207*a* are turned off in response to the timing signal from the time control circuit 6 at the time t5 in FIGS. 14A to 14G. The data determination circuit 107 generates the determination signals based on the latched voltage levels and drives the bias control circuit 108. The bias control circuit 108 generates the signals BN1 to BN64 and BP1 to BP64. Thus, at the time t6 in FIGS. 14A to 14G, the gradation amplifiers 201 stay in an inactive state or are changed to an active state depending on the signals BN1 to BN64 and BP1 to BP64 from the bias control circuit 108. Then, the switches 202 are selectively turned on based on the determination signals from the data determination circuit 107. Moreover, the switches 206 are turned on in response to a timing signal from the time control circuit 6. In this way, the gradation voltages are applied to the data lines by only the gradation amplifiers in an active state.

As described above, it becomes possible to simultaneously determine which of 64 values, 00H to 3FH, corresponds to each of the data lines. In this way, the image data for one horizontal line (or scanning line) is determined and unnecessary gradation amplifiers are turned to an inactive state based on the determined image data, allowing the gradation amplifier circuit to operate at low power and further permitting the display unit to be driven with low power. For example, when it is supposed that the gradation amplifiers consumes about 10 μA, the power consumption of 3.15 mW (=10 μA*5V*63) can be reduced at maximum in a full monochromatic display, if the drive voltage is 5 V. Also, because the decoding function to determine the image data and the decoding function to select the gradation voltages are achieved by the same decoder circuit, the data determination circuit 107 may be constituted of latch circuits (not shown), resulting in reduction of the circuit scale.

Also, when the drive circuit of the display unit is manufactured to contain the frame memory 101 as in a semiconductor integrated circuit, there is a case that the number of pixels of the display unit and the number of pixels of the frame memory are different. When the number of pixels of the frame memory is larger than the number of pixels of the display unit, for example, in case of the 120×160 pixels in the display unit and the 144×176 pixels in the frame memory, image data for 72 (=24×3) un-connected data lines is not supplied from the CPU 2. Therefore, the frame memory 101 has random data in an area corresponding to these un-connected data lines, and this area must be made invalid in the case of the data determination. In order to make it invalid, the switches 206 which are not connected to the data lines are always turned off based on an instruction from the command control circuit 5. Also, because 16 scanning lines are not connected, the gradation amplifiers of the data line drive circuit 1 are set to inactive state during a period corresponding to the un-connected scanning lines in response to the timing signals supplied from the time control circuit 6 based on an instruction from the command control circuit 5. Thus, power consumption can be reduced.

Second Embodiment

Figure 15:
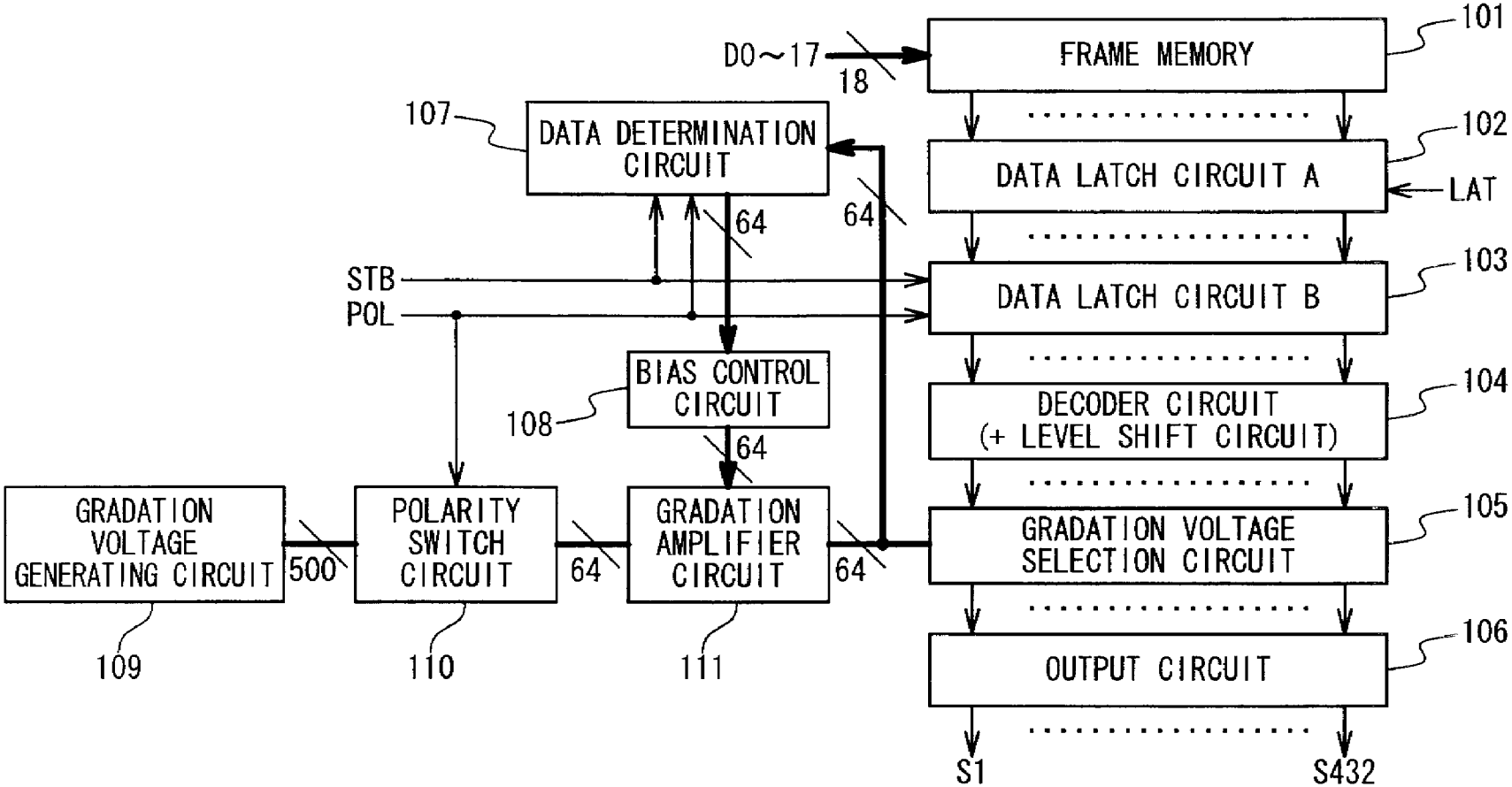
FIG. 15 is a block diagram of the drive circuit according to a second embodiment of the present invention.
Figure 16:
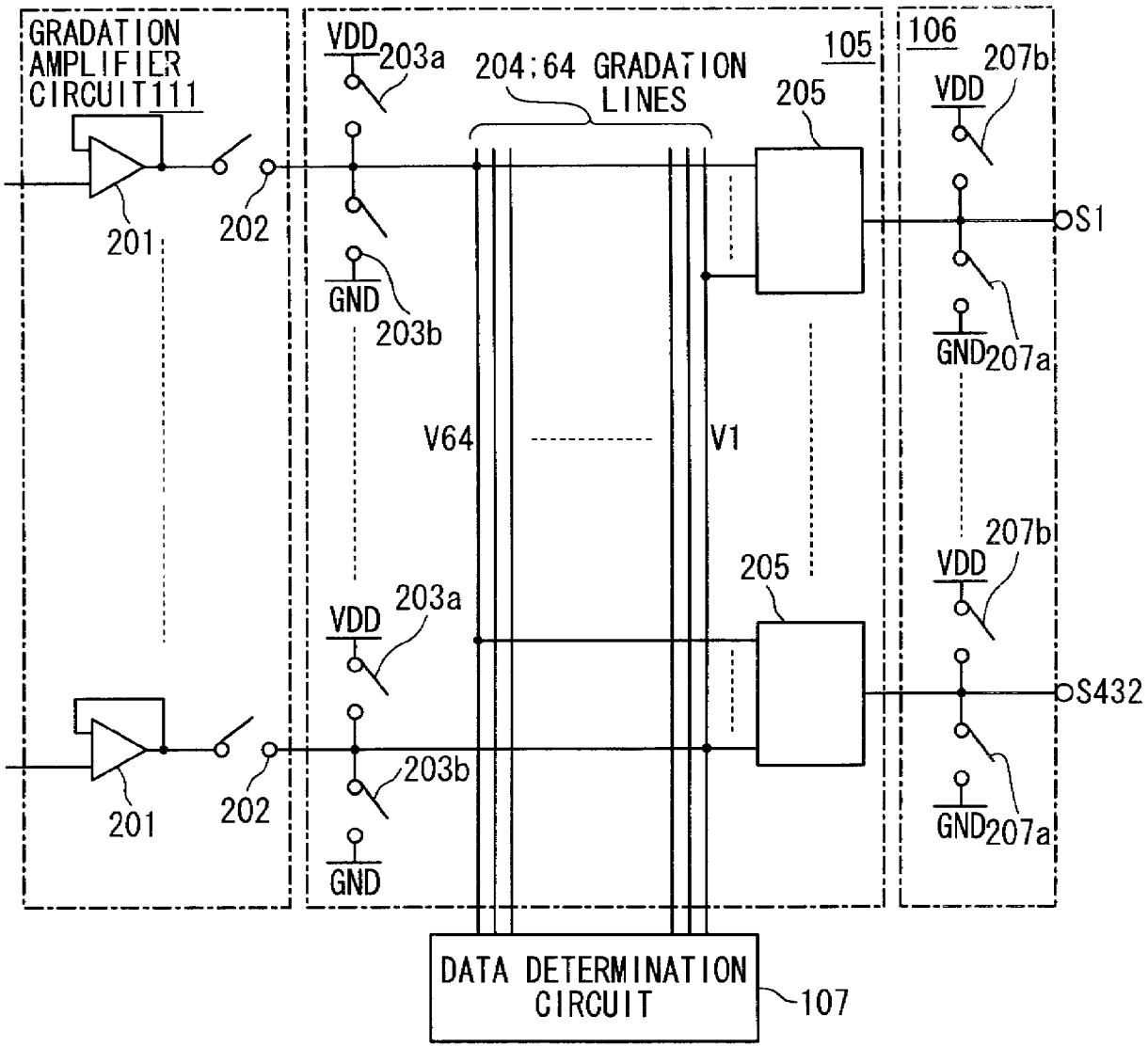
FIG. 16 is a block diagram of the data determination circuit in the second embodiment.
Figures 17A, 17B, 17C, 17D, 17E, 17F, 17G, 17H, 17I, 17J:
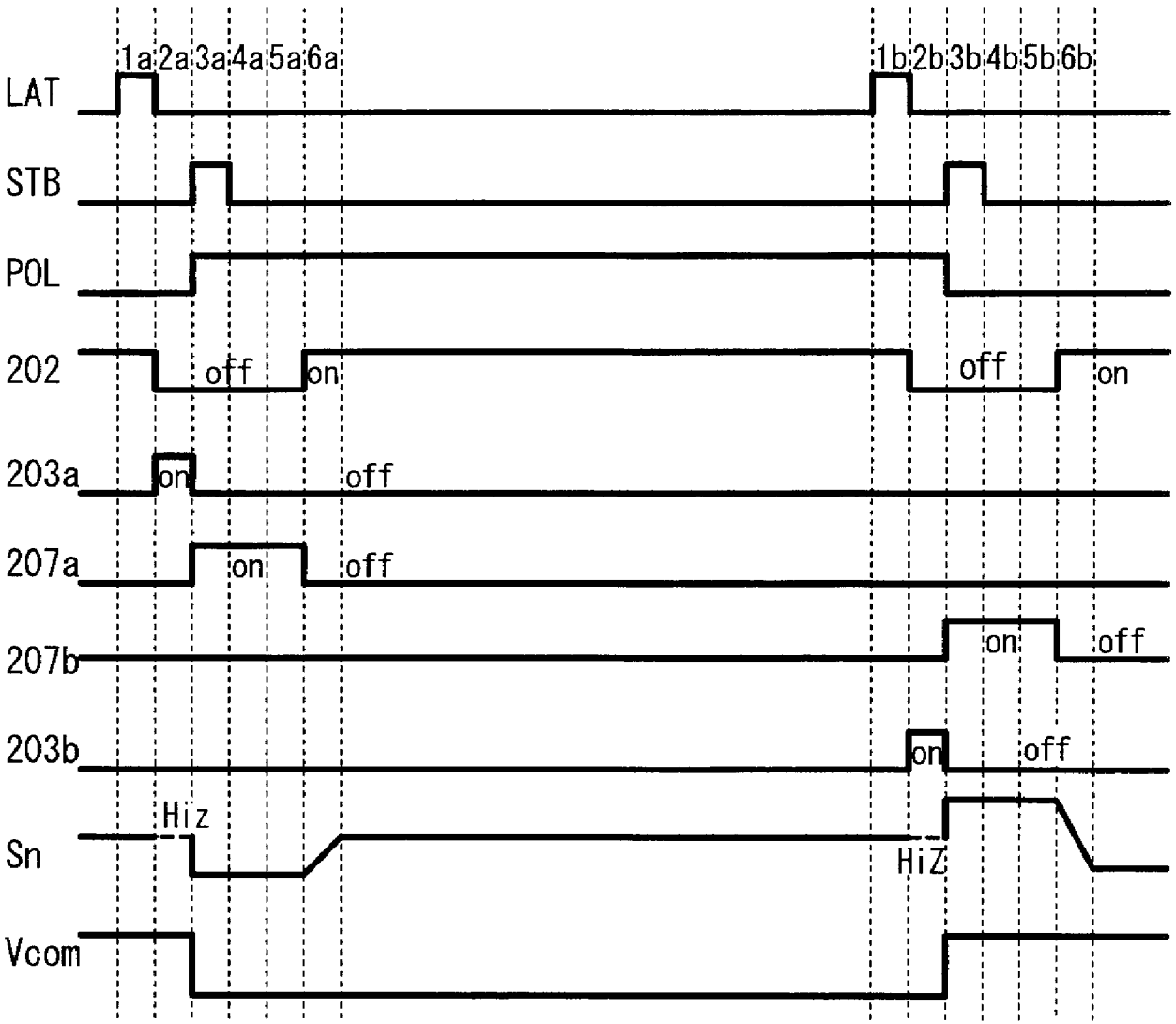
FIGS. 17A to 17J are timing charts in the data determination in the second embodiment.

FIG. 15 is a block diagram of the data line drive circuit 1 according to the second embodiment of the present invention, and FIG. 16 shows the circuit configuration which contains the data determination circuit 107 for the data determination. The second embodiment is different from the first embodiment in a part of the circuit structure. In the first embodiment, the switches 206 which are connected to the data lines are set to the off state, and any voltage is not applied to the data lines in the case of the data determination. However, in the second embodiment, the voltage of GND or VDD is applied in the case of the data determination. For this purpose, as shown in FIG. 16, the switches 203*a* which are connected to the gradation lines 204 and the switches 207*a* which are connected to the outputs of the gradation selection switches 205 are common between the first and second embodiments. Also, switches 203*b* which are connected to the gradation lines 204 and switches 207*b* which are connected to the gradation selection switches 205 are added in the second embodiment. The switches 203*a* are connected to VDD and the switches 207*a* are connected to the GND, and the switches 203*b* are connected to the GND and the switches 207*b* are connected to VDD.

Figure 18A:
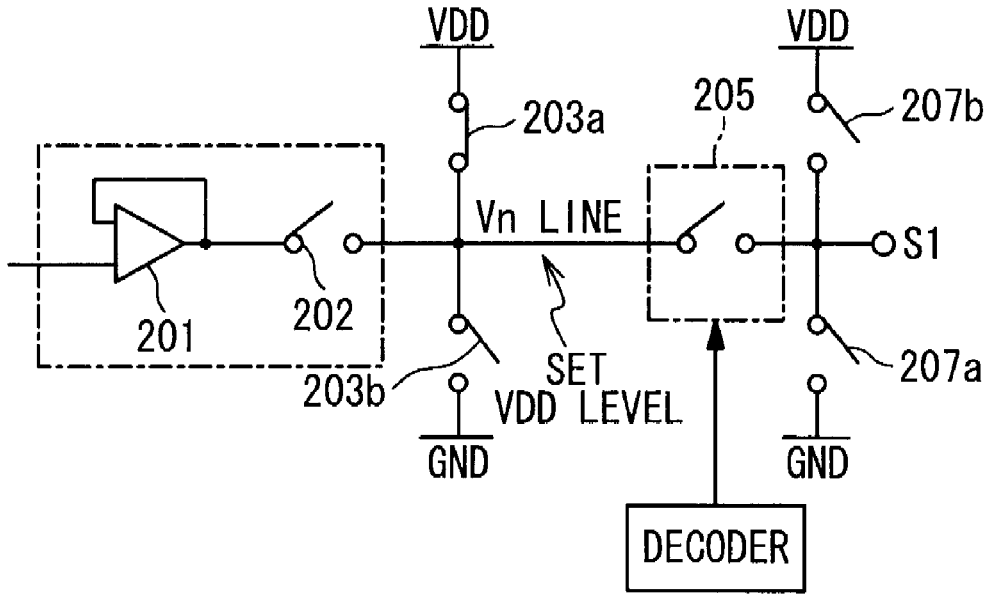
FIGS. 18A to 18D are diagrams showing switch states in the data determination in the second embodiment.

Next, the operation of the second embodiment will be described. FIGS. 17A to 17J show time charts of the operation. Also, the operating states corresponding to those of FIGS. 13A to 13D are shown in FIGS. 18A to 18D. The difference of the second embodiment from the first embodiment in the operation is in that when the image data is determined, the output circuit is not in the high impedance state and outputs voltages in accordance with the polarity signal POL. At the times t1*a* and t1*b* of FIGS. 17A to 17J, the image data stored in the frame memory 101 is read out and transferred to the data latch circuit A 102, and latched therein in response to the latch signal LAT. Next, at the time t2*a* in FIGS. 17A to 17J, the above-mentioned determination signals Cn are all set to "H" together regardless of the image data in response to a timing signal from the time control circuit 6. As a result, the switches 202 are turned off and all the gradation amplifiers 201 are set to the inactive state. Also, the gradation selection switches 205 are turned off regardless of the gradation data in response to a timing signal from the time control circuit 6. Also, the switches 203*a* are turned on in response to a timing signal from the time control circuit 6 and the gradation lines are precharges to the voltage VDD (FIG. 18A).

Figure 18B:
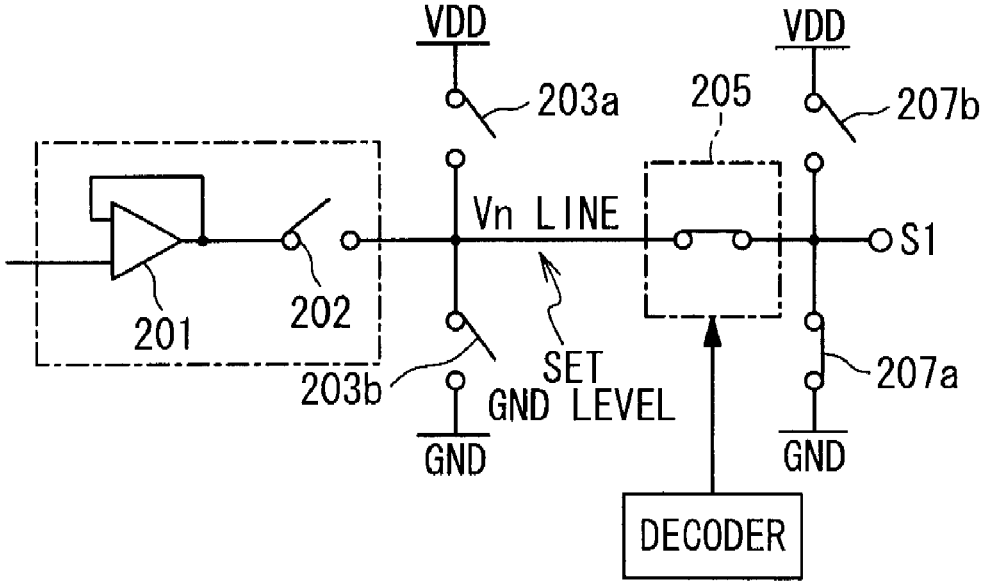
Figure 18C:
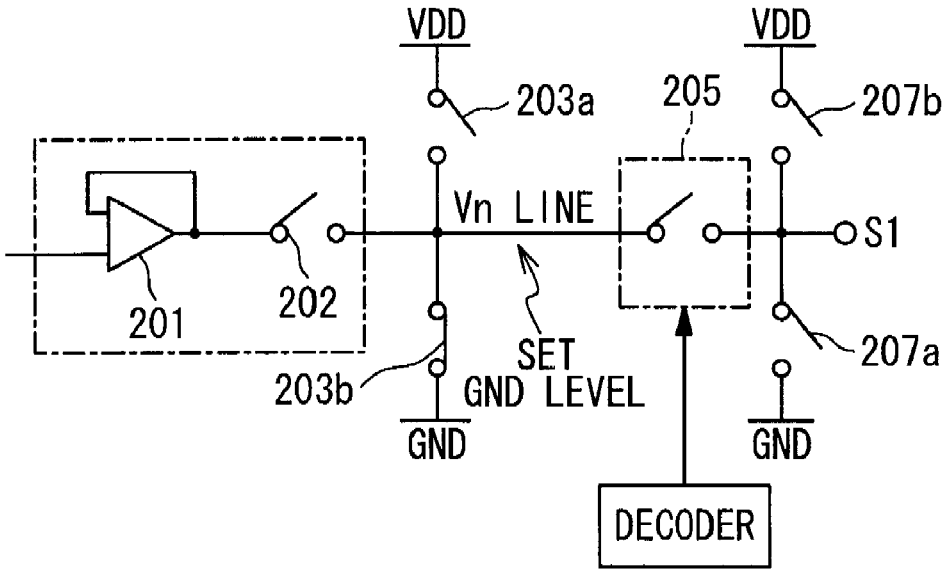

At the time t2*b* in FIGS. 17A to 17J, in response to timing signals from the time control circuit 6, the polarity signal POL is inverted and the switches 203*b* are turned on and the gradation lines are precharged to the voltage GND (FIG. 18C).

At the time t3*a* in FIGS. 17A to 17J, the image data is transferred from the data latch circuit A 102 to the data latch circuit B 103 in response to the horizontal signal STB, and latched therein. Then, the decoder circuit 104 decodes the image data latched in the data latch circuit 103. The switches 203*a* are turned off in response to a timing signal from the time control circuit 6, and the gradation selection switches 205 are selectively turned on and in accordance with the image data decoded by the decoder circuit 104 in response to a timing signal from the time control circuit 6. Moreover, the switches 207*a* are turned on in response to a timing signal from the time control circuit 6. Thus, the data lines are fixed on GND. In this case, the gradation lines are set to the voltage GND when the gradation selection switches 205 are turned on. The gradation lines corresponding to the gradation selection switches 205 in the off state keeps the voltage VDD. The voltage levels of the gradation lines corresponding to the switches 205 are latched in the latch circuit (not shown) of the data determination circuit 107 (FIG. 18B).

Figure 18D:
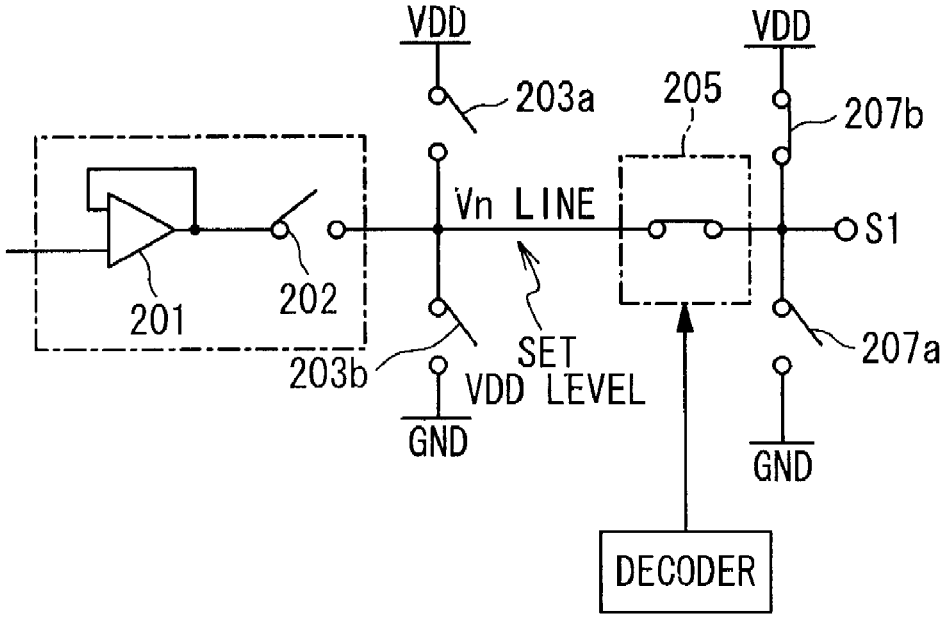

At the time t3*b* in FIGS. 17A to 17J, in response to timing signals from the time control circuit 6, the polarity signal POL is inverted, the switches 203*b* are turned off, and the switches 207*b* are turned on. As a result, the data lines are fixed on of the voltage VDD. The gradation lines 204 corresponding to the gradation selection switch 205 set to the on state in accordance with the image data are set to the voltage VDD (FIG. 18D). The gradation line 204 corresponding to the gradation selection switches 205 in the off state keeps the voltage GND. At times 3*a* and 3*b* in FIGS. 17A to 17J, the voltage levels of the 64 gradation lines 204 should be latched by the latch circuit of the data determination circuit 107 as "1" in case of the voltage VDD and as "0" in case of the voltage GND. As seen from the above, a circuit (not shown) for inverting the image data which is determined in accordance with the polarity signal POL is necessary to the data determination circuit 107 in addition to the latch circuit.

Next, the switches 207*a* are turned off in response to the timing signal from the time control circuit 6 at the time t6*a* in FIGS. 17A to 17J. The data determination circuit 107 generates the determination signals based on the latched voltage levels and drives the bias control circuit 108. The bias control circuit 108 generates the signals BN1 to BN64 and BP1 to BP64. Thus, at the time t6*a* in FIGS. 17A to 17J, the gradation amplifiers 201 are kept to the inactive state or set to the active state based on the signals BN1 to BN64 and BP1 to BP64 from the bias control circuit 108. Also, the switches 202 are selectively turned on based on the determination signals from the data determination circuit 107. Moreover, the switches 206 are turned on in response to a timing signal from the time control circuit 6. In this way, the gradation voltages are applied from only the gradation amplifiers in the active state to the data lines.

Similarly, at the time 6*b* in FIGS. 17A to 17J, the switches 207*b* are turned off, and the gradation amplifiers 201 are kept to the inactive state or is set to the active state based on the determination result by the data determination circuit 107 in response to the signals from the bias control circuit 108. The gradation voltages determined in accordance with the image data can be applied to the data lines.

In the first embodiment, the switches connected to the data lines are set to the high impedance during the data determination. However, in the second embodiment, in accordance with the operation of Vcom circuit 11, the data lines are fixed on VDD or GND. This is to prevent that the data lines are inverted with the influence of the cross talk when Vcom is inverted so that a voltage higher than the voltage endurance is not applied to the drive circuit system. Also, the switch 206 in the first embodiment may be added to the second embodiment.

Third Embodiment

Figure 19:
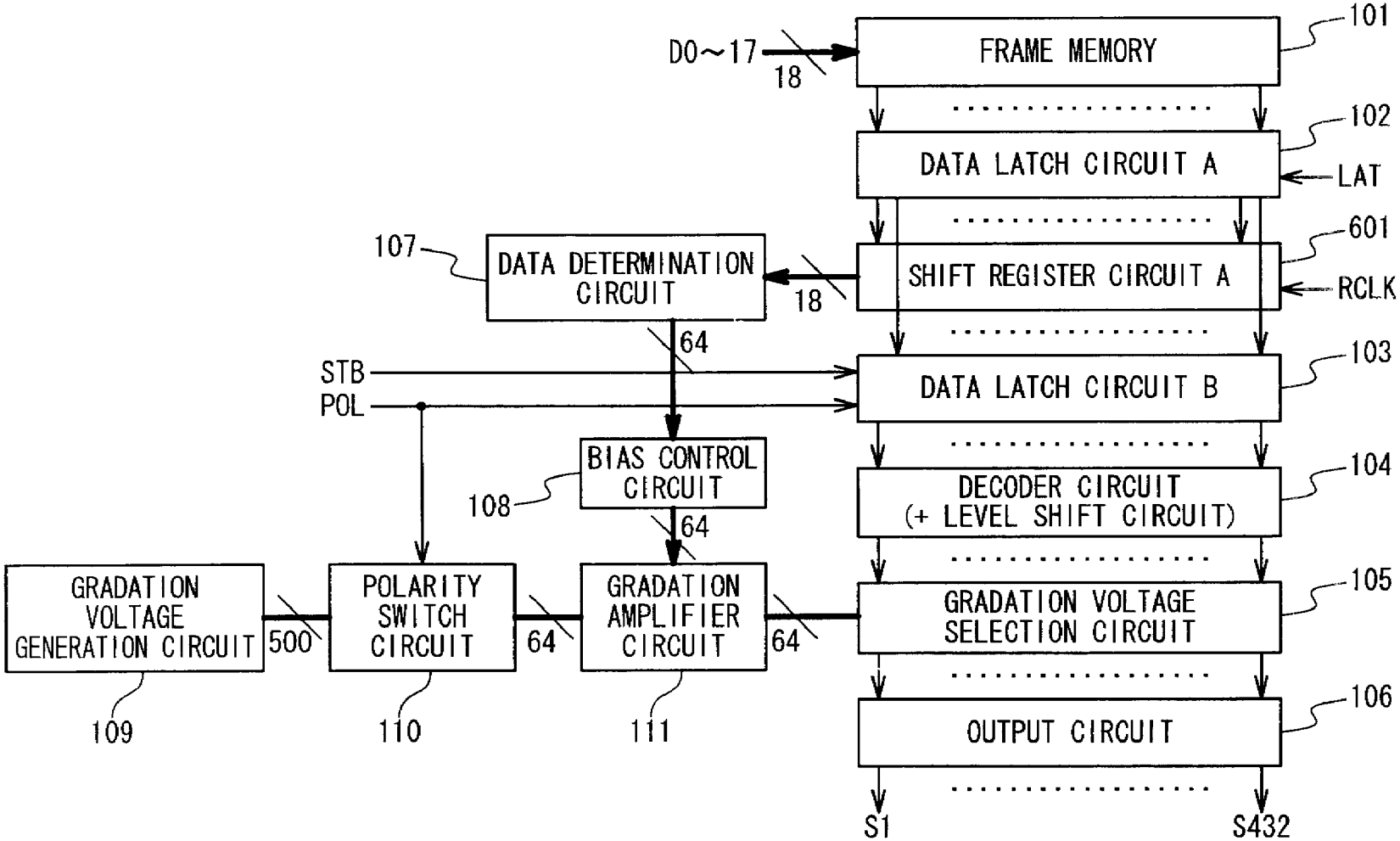
FIG. 19 is a block diagram of the data line drive circuit according to a third embodiment of the present invention.

FIG. 19 shows a block diagram of the data line drive circuit 1 according to the third embodiment of the present invention. In this embodiment, the position of a shift register circuit A 601 is different, compared with the conventional structure shown in FIG. 11*n* the conventional example, the shift register circuit 901 is provided in the front-stage of the data latch circuit A 902 and has the function to generate the sampling signal such that the image data is latched in the data latch circuit A 902 in order. However, in this embodiment, the shift register circuit 601 is provided in the back-stage of the data latch circuit A 102, and has the function to transfer the image data latched in the data latch circuit A 102 to the data determination circuit 107 in order in synchronous with a clock signal RCLK.

Figure 20:
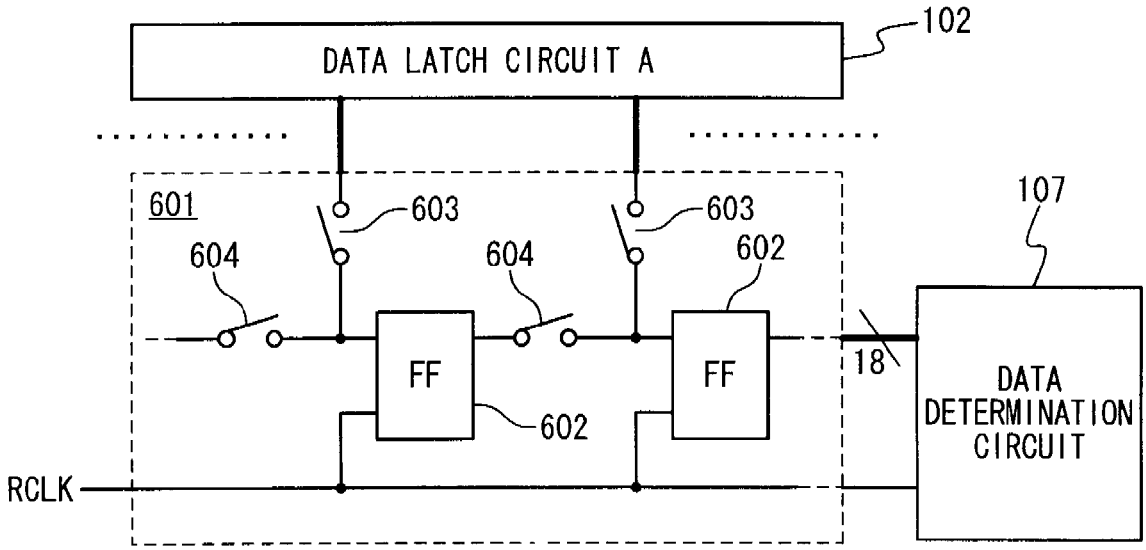
FIG. 20 is a block diagram of the data determination circuit in the third embodiment.

Also, FIG. 20 shows a data determining section. The shift register circuit A 601 is composed of two flip-flops 602 and switches 603 and 604 for every bit data. The data determination circuit 107 is composed of three 6-input NANDs, one 3-input NAND and the latch circuit, although being not shown in the figure.

Next, the operation will be described. The image data stored in the frame memory 101 is transferred to the data latch circuit A 102 with a line memory function in synchronous with the latch signal LAT which is asynchronous with the signal 12 of the CPU 2. The image data latched in the data latch circuit A 102 is transferred to the data determination circuit 107 in order in synchronism with the clock signal RCLK which is asynchronous with the signal 12 of the CPU 2, by the shift register circuit A 601 provided in the back-stage of the data latch circuit A 102. The clock signal RCLK is stopped when the image data for one line is determined and the data determination is ended. Next, the image data is transferred to the data latch circuit B 103 in response to the horizontal signal STB, the gradation selection switches 205 are selected in accordance with the image data and the data lines of the display unit are driven. When the drive of the data lines ends and the next latch signal LAT is supplied, the image data determined by the data determination circuit 107 is reset and the data determination for the next line is started.

Figure 21A:
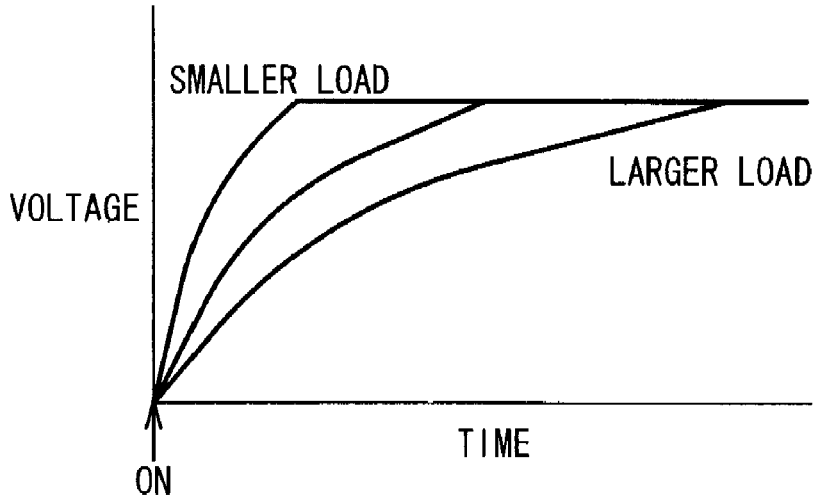
FIGS. 21A to 21B are graphs showing timings when the gradation amplifier circuit is set to an active state.
Figure 21B:
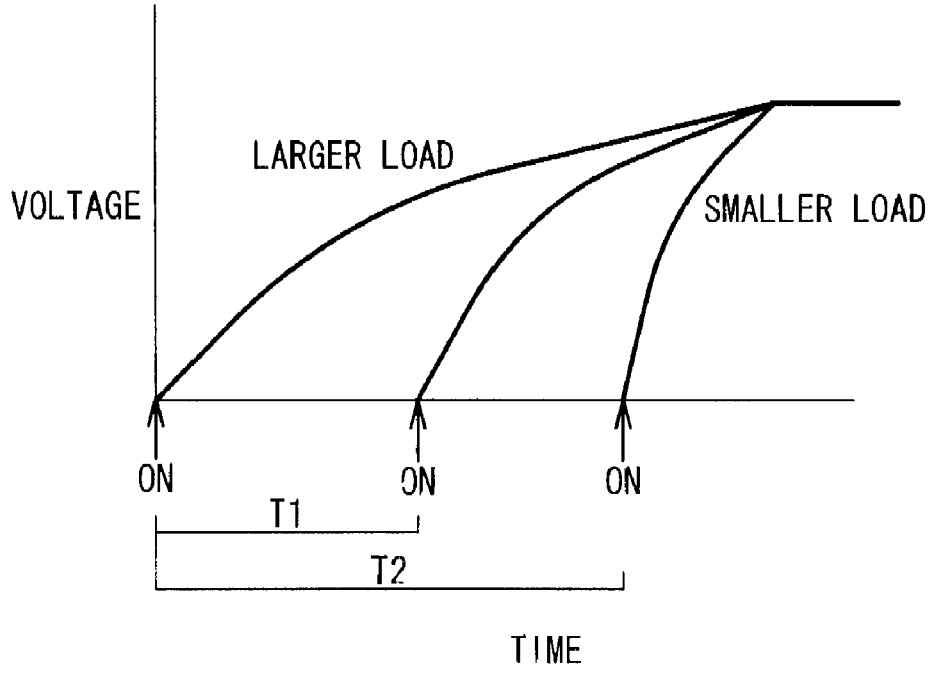

Also, if a counter (not shown) is added to the data determination circuit 107, it is possible to determine by how many data line the each gradation is used. Low power consumption drive can be achieved by providing the function to change the drive time in accordance with this counter value, as shown in FIGS. 21A and 21B. For example, if all the data lines have the same data, the gradation amplifier in the active state is only one, and the load of the gradation amplifier becomes very large, resulting in a large output delay. However, when there are two or more kinds of data, the number of gradation amplifiers in the active state is two or more. In this case, the power consumption becomes large but the output delay becomes small, because the loads are distributed and the capacitive load of the gradation amplifier becomes small. As a result, it is possible to drive the gradation amplifiers in a short active time. Specifically, when the right half of the display screen is white and the left half of the display screen is black, two gradation amplifiers are in the active state. However, the output delay time becomes short because the capacitive loads of the gradation amplifiers become a half, compared with a case that the whole of screen is the same color. In the same way, when a 64-color display is carried out at the same time, the power consumption of the gradation amplifiers becomes 64 times, compared with a case that the whole screen is displayed in a black or white color. However, it is possible to reduce the power consumption largely by changing the active timings of the gradation amplifiers in accordance with the number kinds of the image data.

Fourth Embodiment

Figure 22:
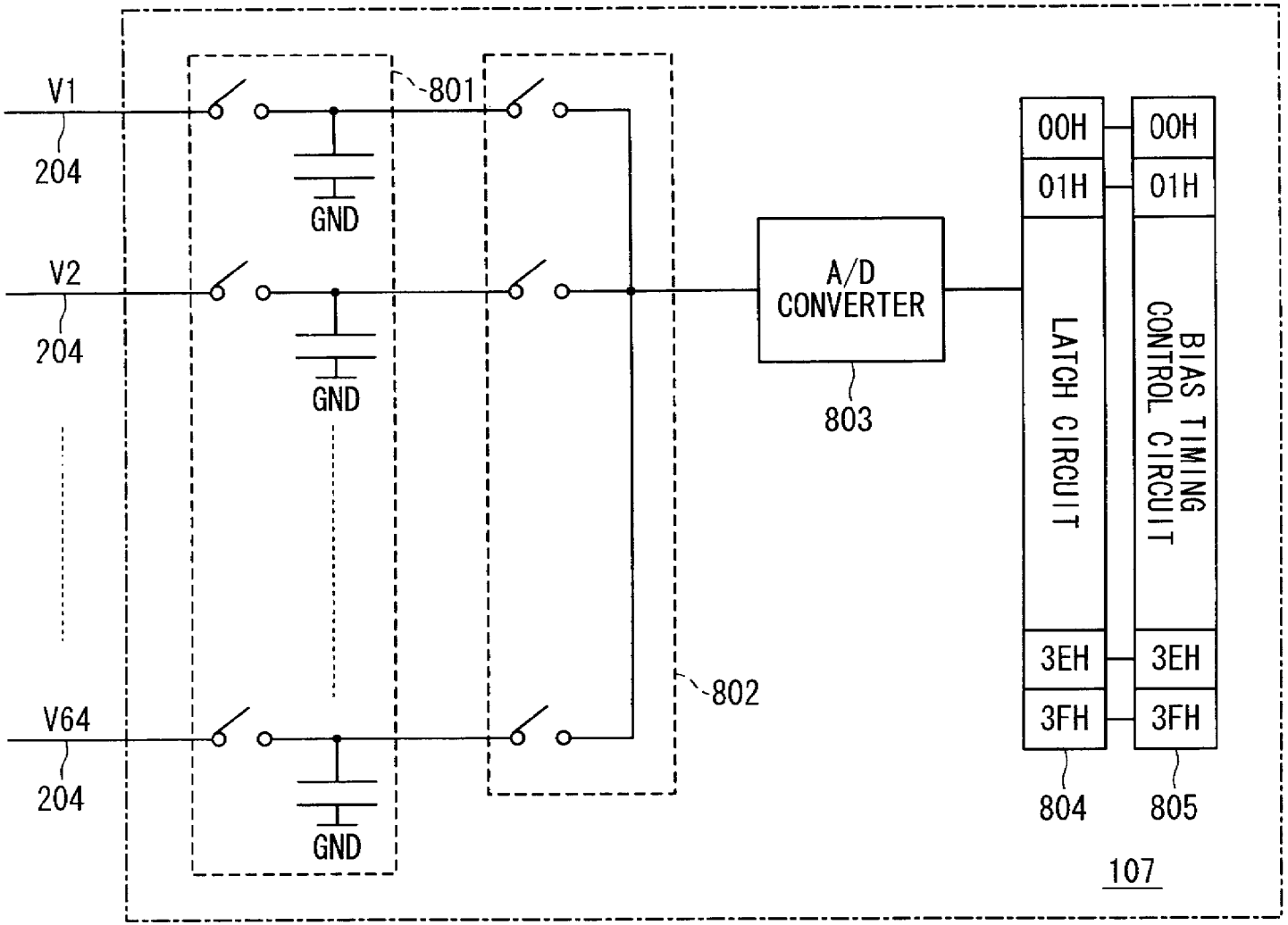
FIG. 22 is a block diagram of the data determination circuit according to a fourth embodiment of the present invention.

In the first embodiment, the data determination circuit 107 has only the function to activate the gradation amplifiers 201 in case of data of "1" and to inactivate it in case of the data of "0", because the data held by the latch circuit (not shown) is binary data of 0 or 1. However, in the fourth embodiment, it is possible to change an active time period by allocating a constant current source function to the switches 207*a* of FIG. 12 and an A/D conversion function to the data determination circuit 107, moreover by using the determination data of plural bits to add a time data to the determination signal. FIG. 22 shows the detail of the data determination circuit 107 which has the A/D conversion function. It is enough to provide one A/D conversion circuit 803, and a sample hold circuit 801 is provided for each gradation line to have a switch and a capacitor. The A/D conversion circuit 803 is switched between the gradation lines in order by a switch circuit 802 to measure a voltage of the connected gradation line. The measured voltage is latched in the latch circuit 804. The bias time control circuit 805 changes the active time periods of the gradation amplifiers 201 in accordance with the number of data latched in the latch circuit 804, like the third embodiment. Thus, the power consumption can be reduced.

More specifically, if a constant current value of the switch 207*a* in FIG. 12 is 0.1 μA, the current of 43.2 μA flows when 432 data lines are used for the same data. Because dt=C (capacitance C)×V (voltage)/I(current), electric charge is lost in the time 1.16 μs (dt=10 pF×5V/43.2 μA), if the capacitance of the sample hold circuit 803 has 10 pF. When 144 data lines are used for the same data, the voltage after 1.16 μs becomes about ⅔. In this way, if the time period necessary for the data determination is previously set and the voltage change in the time period is detected by the A/D conversion circuit, it is possible to approximately detect the number of data to each gradation. In order to give the switches 207*a* the constant current function, it is sufficient to adjust the gate voltage of the transistor of each switch.

Fifth Embodiment

Figure 23:
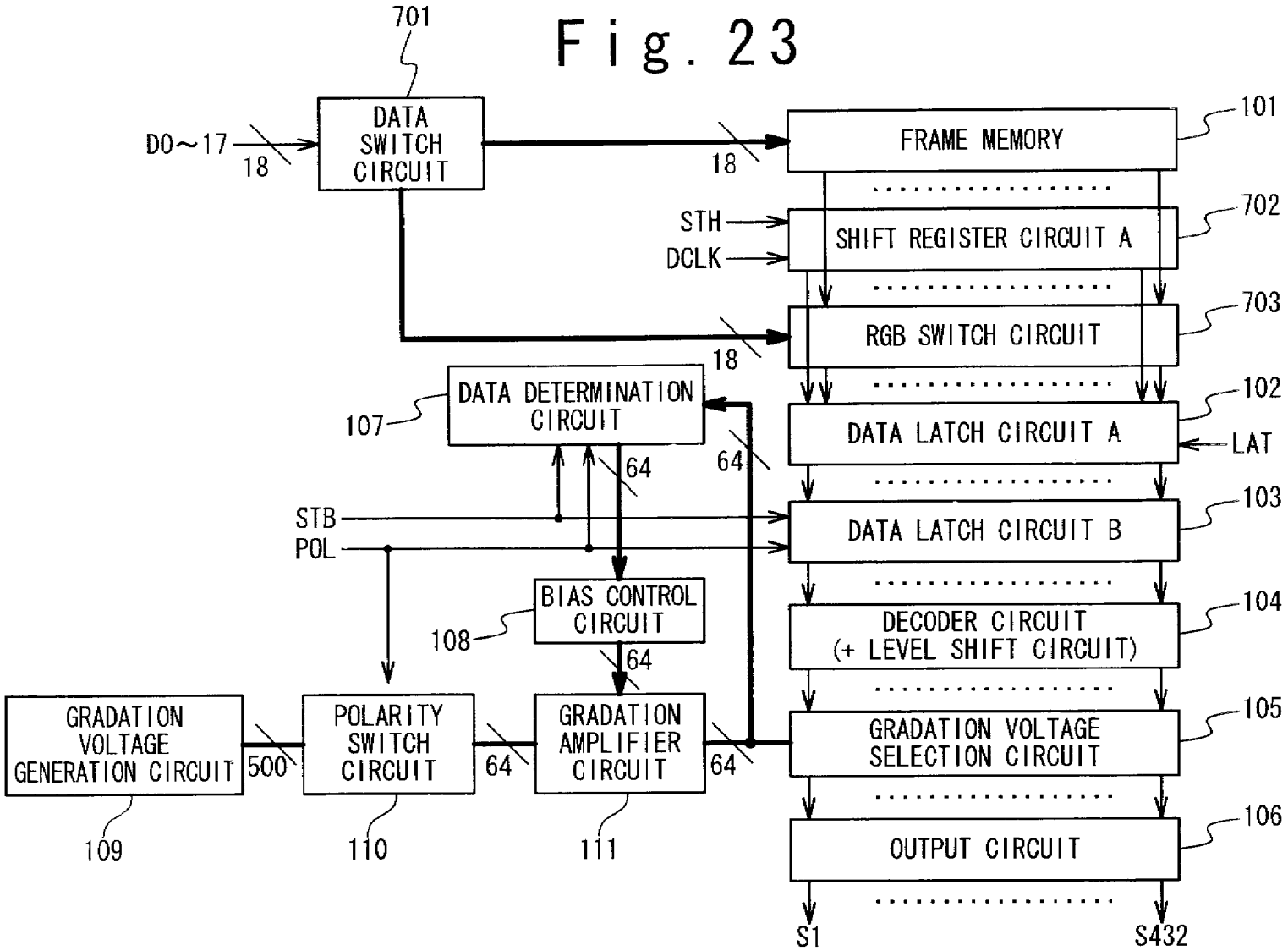
FIG. 23 is a block diagram of the drive circuit according to a fifth embodiment of the present invention.

FIG. 23 shows a block diagram of the data line drive circuit 1 according to the fifth embodiment of the present invention.

The fifth embodiment is different from the first embodiment in that a mode in which the image data is stored in the frame memory and a mode in which the image data is not stored can be selected. In the portable phone, a still image is displayed in many cases but a video image is sometimes displayed. When the vide image is displayed, the power consumption becomes large when the video image data is written in the frame memory 101. For this reason, it is better to transfer the video image data directly to the data latch circuit A 102 as a line memory without writing the video image data in the frame memory 101 in case of the video image display. Because the video image data can be supplied in synchronism with the signal 12 from the CPU 2 in the case of the video image display, the shift register circuit 702 is provided for this purpose. Also, a data switching circuit 701 and an RGB switching circuit 703 are provided to switch whether the image data is transferred to the frame memory 101 or the data latch circuit A 102 in accordance with the still image display or the video image display.

Figures 24A, 24B:
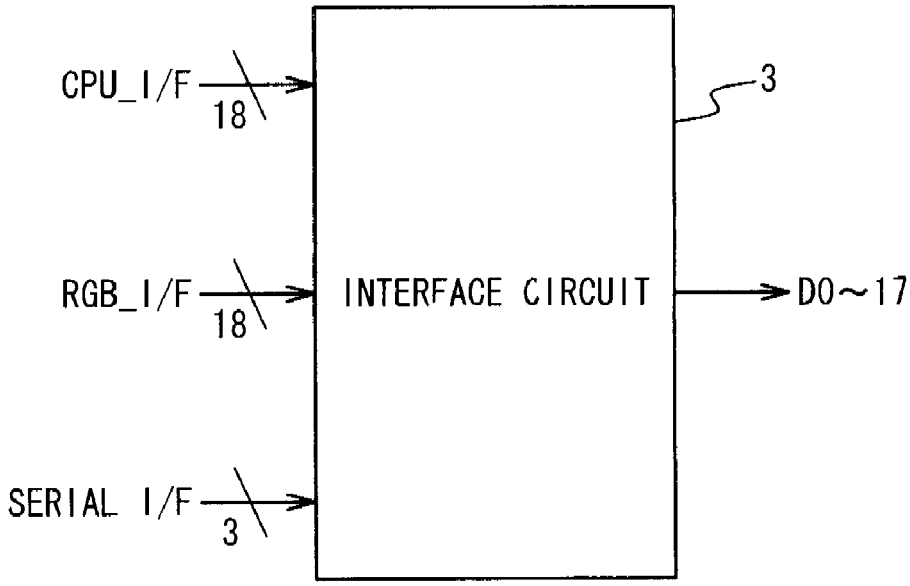
FIGS. 24A and 24B are a block diagram showing an interface circuit and image data input system.

As shown in FIG. 24A, in the data switching circuit 701, the input is switched by an interface circuit 3. In the video image display, the video image data is transferred to the data latch circuit A 102 directly by the data switching circuit 701 and the RGB switching circuit 703. In the still image display, image data is transferred to the frame memory 101 by the data switching circuit 701. The data shift register circuit 702 stops the operation in the still image display. The operation of the circuit after the data latch circuit A 102 is the same as the operation in the first embodiment. The data switching circuit 701 and the RGB switching circuit 702 may be added to the structure of the third embodiment shown in FIG. 19. As shown in FIG. 24B, there is a case that signal lines when the image data is supplied from the CPU 2 are different depending on the still image data or the video image data. MODE 1 and 4 are mainly used in the case of the vide image display, and MODE 2 and 3 are mainly used in the case of the still image. The switching is carried out by the interface circuit 3.

The first to fifth embodiments of the present invention are described in the above. However, in the present invention, the structures described in the first to fifth embodiments can be combined appropriately.

As described above, according to the present invention, in the data side drive circuit having the frame memory, the power consumption can be reduced because the gradation amplifiers are made active or inactive in accordance with the image data. Also, when image data from the frame memory are collectively determined like the first embodiment, it is possible to reduce the number of circuit components of the data determination circuit. Specifically, in case that the NAND circuits are used for the data determination circuit as in the conventional example, 64 6-input NAND are necessary for every data line and 768 transistors are necessary. However, in the present invention, the decoder circuit which has been originally provided is used, and the new components are the plurality of switches connected to the gradation lines and the switches of the output circuit which are connected to the data lines. Therefore, the number of necessary components can be reduced largely. In the third embodiment, the shift register circuits are necessary to transfer the image data to the data determination circuit, and the number of the shift register circuits is 288 (=16×18 bits) per data line at minimum. However, the reduction of the circuit scale is still achieved. The low power consumption drive can be achieved by adding a counter function to the data determination circuit and by controlling the active time period of the gradation amplifier in accordance with the number of data of the image data.

What is claimed is:

1. A drive circuit which drives data lines of a display unit, comprising:

a first drive section configured to output a first output signal at a first timing during a horizontal period;

a second drive section configured to output a second output signal at a second timing after said first timing during the horizontal period; and a counter configured to count image data for every gradation during the horizontal period, wherein said first output signal is outputted at said first timing when the count value is more, and said second output signal is outputted at said second timing when the count value is less, and wherein a through-rate of said second output signal is larger than that of said first output signal.

2. The drive circuit according to claim 1, wherein a period for which said second drive section is activated is set to be shorter when the count value is less.

* * * * *

UNITED STATES PATENT AND TRADEMARK OFFICE

CERTIFICATE OF CORRECTION

PATENT NO. : 8,111,230 B2
APPLICATION NO. : 11/866240
DATED : February 7, 2012
INVENTOR(S) : Daisaburou Nakai et al.

It is certified that error appears in the above-identified patent and that said Letters Patent is hereby corrected as shown below:

On the title page, item (73) Assignee: delete "Renesas Electronics Corporations, Kanagawa (JP)" and insert -- Renesas Electronics Corporation (Kanagawa, JP) --

In the Specification

Figure 1:
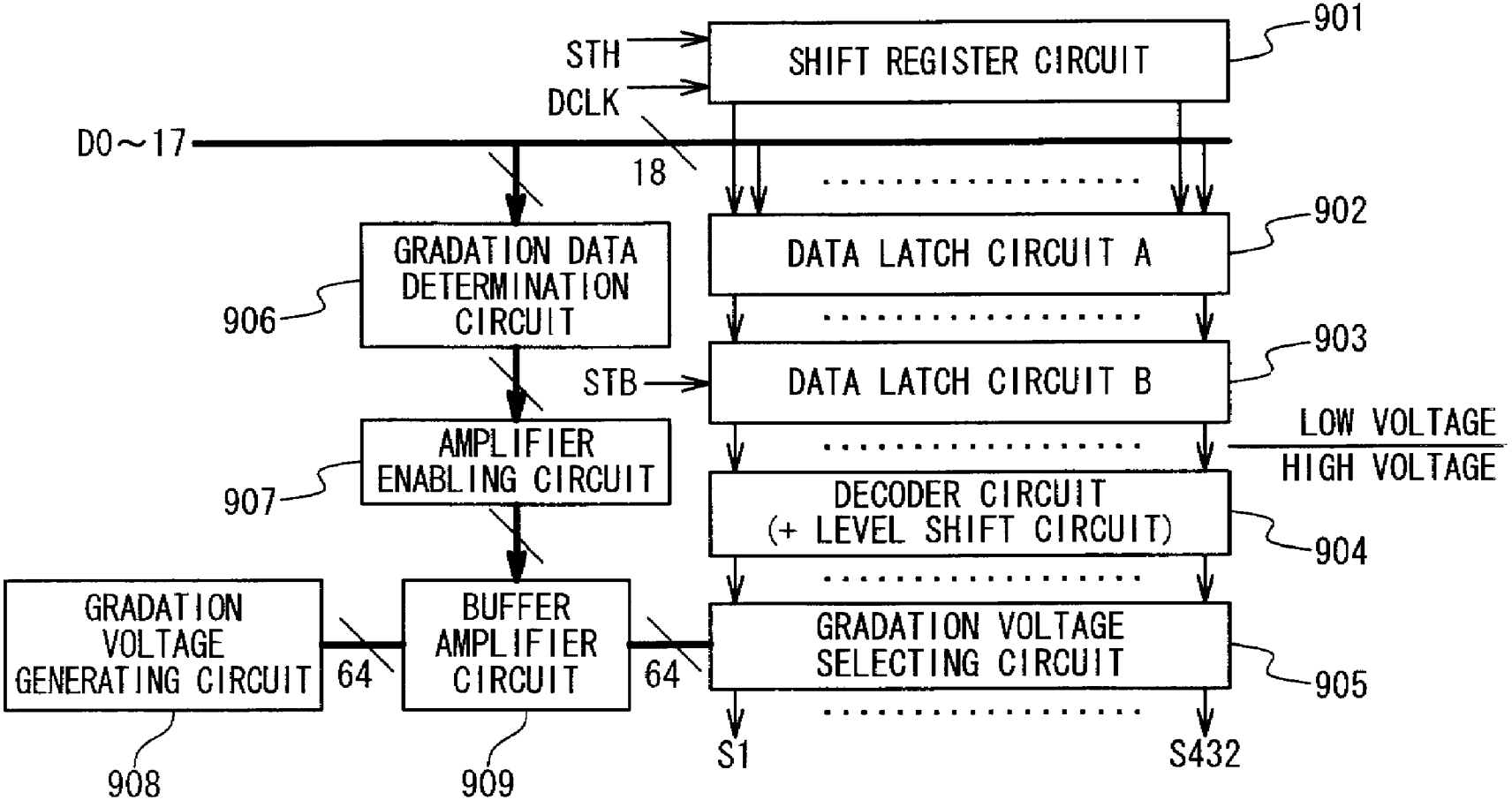
Fig. 1 PRIOR ART
FIG. 1 is a block diagram of a data line drive circuit of a conventional display apparatus.
Figure 2:
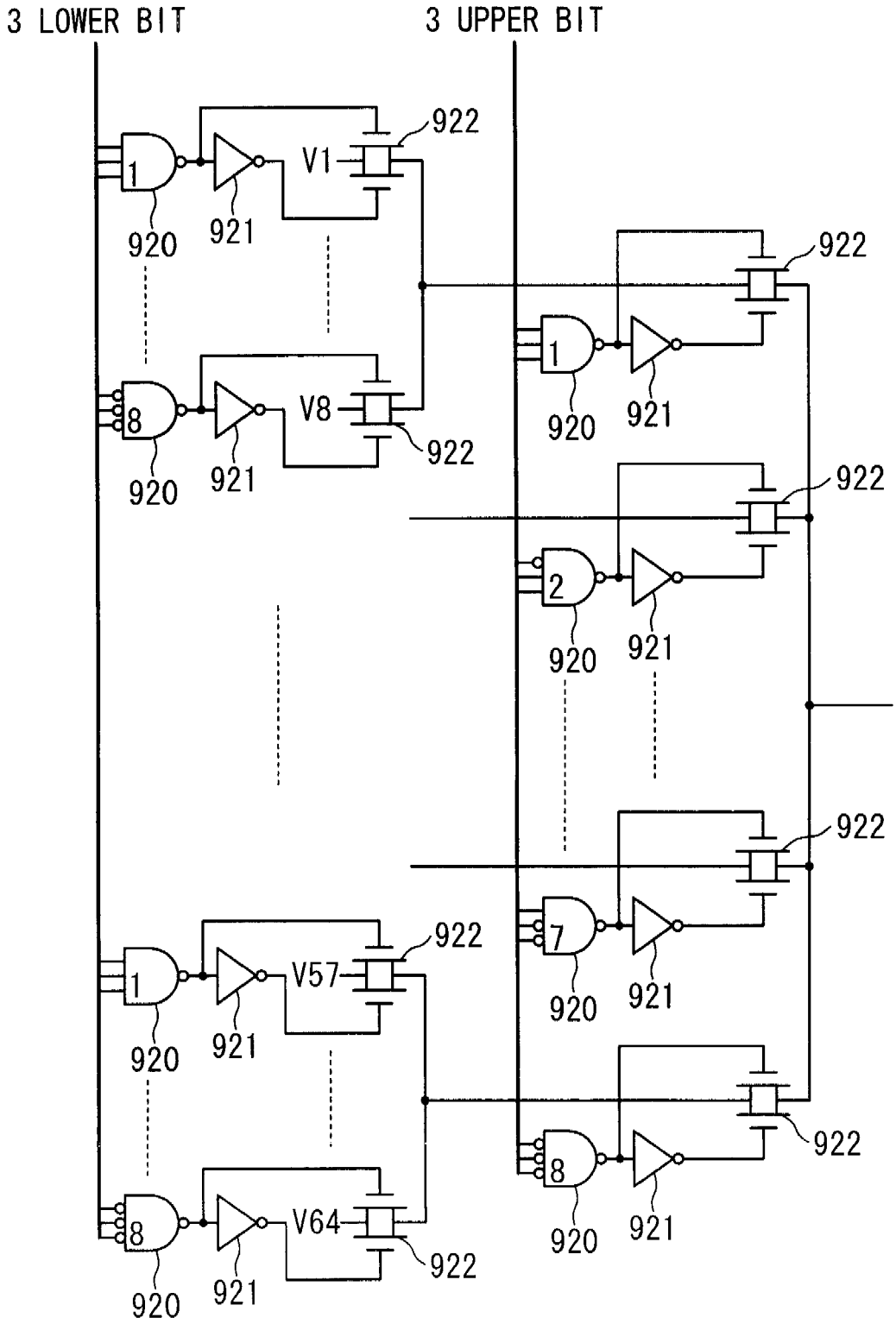
Fig. 2 PRIOR ART
FIG. 2 is a block diagram of a decoder circuit and a gradation voltage selection circuit in the conventional display apparatus.
Figure 3:
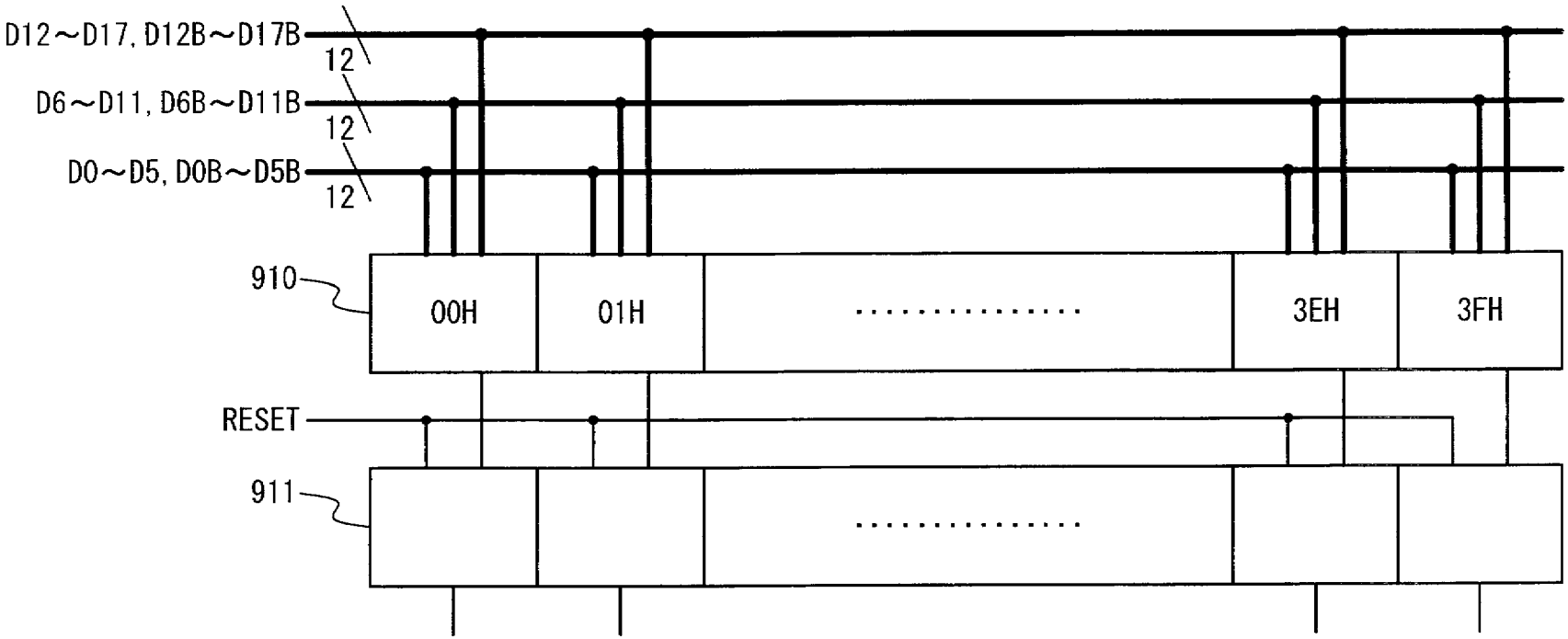
Fig. 3 PRIOR ART
FIG. 3 is a block diagram of a determination circuit in the conventional display apparatus.

Column 15, Line 30: delete "FIG. 11n" and insert -- FIG. 1. In --

Column 17, Line 6: delete "vide" and insert -- video --

Column 17, Line 35: delete "vide" and insert -- video --

Signed and Sealed this
Twentieth Day of May, 2014

Michelle K. Lee

Michelle K. Lee
*Deputy Director of the United States Patent and Trademark Office*